US007757782B2

(12) United States Patent
Tashiro et al.

(10) Patent No.: US 7,757,782 B2
(45) Date of Patent: Jul. 20, 2010

(54) METHODS AND APPARATUS FOR NAVIGATING A TOOL DOWNHOLE

(75) Inventors: Hitoshi Tashiro, Kamakura (JP); Ryuki Odashima, Yokohama (JP); Joonhyung Bae, Sagamihara (JP); Ahmed Tahoun, Kuala Lumpur (MY)

(73) Assignee: Schlumberger Technology Corporation, Sugar Land, TX (US)

( * ) Notice: Subject to any disclaimer, the term of this patent is extended or adjusted under 35 U.S.C. 154(b) by 88 days.

(21) Appl. No.: 11/608,238

(22) Filed: Dec. 7, 2006

(65) Prior Publication Data

US 2008/0135293 A1 Jun. 12, 2008

(51) Int. Cl.
*E21B 25/16* (2006.01)
*E21B 7/04* (2006.01)

(52) U.S. Cl. ..... 175/45; 175/73; 166/254.2; 166/250.17

(58) Field of Classification Search ..... 175/45, 175/73; 166/254.2, 250.17
See application file for complete search history.

(56) References Cited

U.S. PATENT DOCUMENTS 4,071,959 A * 2/1978 Russell et al. ..... 33/312
4,171,031 A * 10/1979 Marquis ..... 181/102
5,022,484 A 6/1991 Panetta et al.
5,415,238 A 5/1995 Nice
5,727,641 A 3/1998 Eddison et al.
6,002,257 A 12/1999 Thomas et al.
6,092,610 A * 7/2000 Kosmala et al. ..... 175/61
6,209,645 B1 4/2001 Ohmer
6,719,069 B2 * 4/2004 Alft et al. ..... 175/24
7,093,370 B2 * 8/2006 Hansberry et al. ..... 33/313
2005/0173153 A1 8/2005 Alft et al.
2005/0279498 A1 * 12/2005 Nakajima et al. ..... 166/255.2

FOREIGN PATENT DOCUMENTS

GB 2353547 2/2001
WO 98/02638 1/1998
WO 2005/019598 3/2005

* cited by examiner

*Primary Examiner*—William P Neuder
*Assistant Examiner*—Yong-Suk Ro
(74) *Attorney, Agent, or Firm*—Daryl Wright; Jody DeStefanis; Jeff Griffin

(57) ABSTRACT

Methods and apparatus for navigating a subterranean tool comprising a body member and a head member steerably associated with the body member. A determining unit is configured to determine a transversal target position of a nose of the head member relative to the body member and a steering unit is configured to steer the head member relative to the body member so that the nose of the head member is located at the transversal target position.

28 Claims, 21 Drawing Sheets

METHODS AND APPARATUS FOR NAVIGATING A TOOL DOWNHOLE

FIELD

The present disclosure relates generally to methods and apparatus for downhole navigation of a tool. More particularly, some aspects disclosed herein are directed to methods and systems for guiding a downhole tool in, for example, elongate holes such as open holes and cased holes of wells.

BACKGROUND

Tools such as logging tools and other tools that are suitable for downhole use are deployed in long subterranean holes, such as open holes and cased holes of wells, by introducing the tool into the hole from an opening and then extending the tool into the hole by various known techniques. In a hole that is substantially vertical and free of major obstructions, tool navigation in the hole is possible without the tool getting jammed in the hole such that tool deployment and use is prevented. However, it is common to encounter irregularities, obstructions, and such like in oil wells and often subsurface holes are not vertical due to curvature in the orientation of the holes, such as typically found in deep oil wells. In consequence, tool jamming is a serious problem encountered in poor hole conditions, such as obstructions by the hole perimeter surface.

U.S. Pat. No. 6,002,257 discloses one example of tool navigation downhole. However, conventional methods and systems for tool navigation are not always suitable in highly-deviated and horizontal open holes or cased holes, and in holes that are not uniform in the hole diameter and have non-uniform and irregular profiles of the hole perimeter surfaces.

SUMMARY

The disclosure herein may meet at least some of the above-described needs and others. In one aspect, the disclosure provides a navigation apparatus for a subterranean tool comprising a body member, a head member steerably associated with the body member, a determining unit configured to determine a transversal target position of a nose of the head member relative to the body member, and a steering unit configured to steer the head member relative to the body member so that the nose of the head member is located at the transversal target position. In aspects disclosed herein, the target position may be determined by comparing acquired data relating to profile of a subterranean hole with stored data relating to, for example, hole trajectory and hole configuration. The stored data may include predetermined commands for tool control based on comparison of the acquired profile data and the stored profile data. The steering unit may include an actuator unit configured to move the head member so that the position of the nose relative to the body member is changed and a controller configured to control the actuator unit to move the head member so that the nose is located at the transversal target position.

The determining unit may comprise a sensor unit configured to acquire position information of the nose of the head member and a processor configured to derive the transversal target position based on the position information. The sensor unit may be configured to measure at least two transversal distances between the nose and points on a perimeter surface adjacent to the nose of the head member. The sensor unit may be configured to measure a cross sectional profile of a perimeter surface adjacent to the nose of the head member. The sensor unit may be configured to measure ultrasonic waves reflected from a perimeter surface.

The sensor unit may comprise a transmitter configured to transmit ultrasonic waves toward the perimeter surface and a receiver configured to receive ultrasonic waves reflected from the perimeter surface. The sensor unit may comprise a plurality of mechanical arm sensors and be configured to measure positions of the arms. Each mechanical arm sensor may comprise an independently extendable and retractable arm, a biasing mechanism configured to extend the arm toward a perimeter surface, and a position sensor configured to sense the position of the arm.

The mechanical arm sensors may be located on the head member such that each mechanical arm sensor contacts a different part of a perimeter surface when extended thereto. The mechanical arm sensors may be symmetrically located on the head member with respect to the axis of the head member. Each mechanical arm sensor may have at least one end that is movable in an axial direction with respect to the head member and the sensor unit may comprise a position sensor configured to output signals based on movement of the movable end of the arm.

The sensor unit may comprise one or more touch sensor. The determining unit may comprise memory configured to store trajectory data with respect to a subterranean reference point, a sensor unit configured to acquire position information of the nose relative to the reference point and a processor configured to determine the target position of the nose based on the trajectory data and the position information. The sensor unit may comprise a gyroscope. The sensor unit may comprise a geomagnetic sensor and acceleration sensor.

The actuator unit may comprise a pivoting mechanism configured to swing the head member in two swing planes that are orthogonal to each other. The actuator unit may comprise a pivoting mechanism configured to swing the head member in at least one swing plane and a rotating mechanism configured to rotate the head member about a center axis of the body member.

The navigation apparatus may be located at a terminal portion of a subterranean tool. The determining unit may be configured to determine a center position in a subterranean hole as the target position of the nose. The determining unit may be configured to determine an aperture of a lateral hole in a main subterranean hole as the target position of the nose head member. The apparatus may be configured to be located at a terminal portion of a subterranean tool that is deployed by at least one of wireline, slickline, coiled tubing.

In other aspects disclosed herein, a tool used in open holes or cased holes of subterranean wells is provided having a tool navigation apparatus comprising a body member, a head member steerably associated with the body member, a determining unit configured to determine a transversal target position of a nose of the head member relative to the body member and a steering unit configured to steer the head member so that the nose is located at the target position. The steering unit may comprise an actuator unit configured to manipulate the head member so that the relative transversal position of the nose of the head member is changed and a controller configured to control the actuator unit so that the nose of the head member is located at the target position determined by the determining unit. The determining unit may comprise an acquisition unit configured to acquire position information of the nose of the head member and a processor configured to derive the target position based on the position information.

Aspects disclosed herein provide a method for navigating a tool in a subterranean hole comprising deploying a tool having a body member and a head member steerably associated with the body member, determining a transversal target position of a nose of the head member relative to the body member and steering the head member relative to the body member so that the nose of the head member is located at the transversal target position determined by the determining unit. The head member may be steered by locating the head member at a center position in the hole. The head member may be steered by locating the head member at an aperture of a side hole for entry to a lateral well.

Additional advantages and novel features will be set forth in the description which follows or may be learned by those skilled in the art through reading the materials herein or practicing the principles described herein. Some of the advantages described herein may be achieved through the means recited in the attached claims.

BRIEF DESCRIPTION OF THE DRAWINGS

The accompanying drawings illustrate certain embodiments and are a part of the specification. Together with the following description, the drawings demonstrate and explain some of the principles of the present invention.

Figure 1:
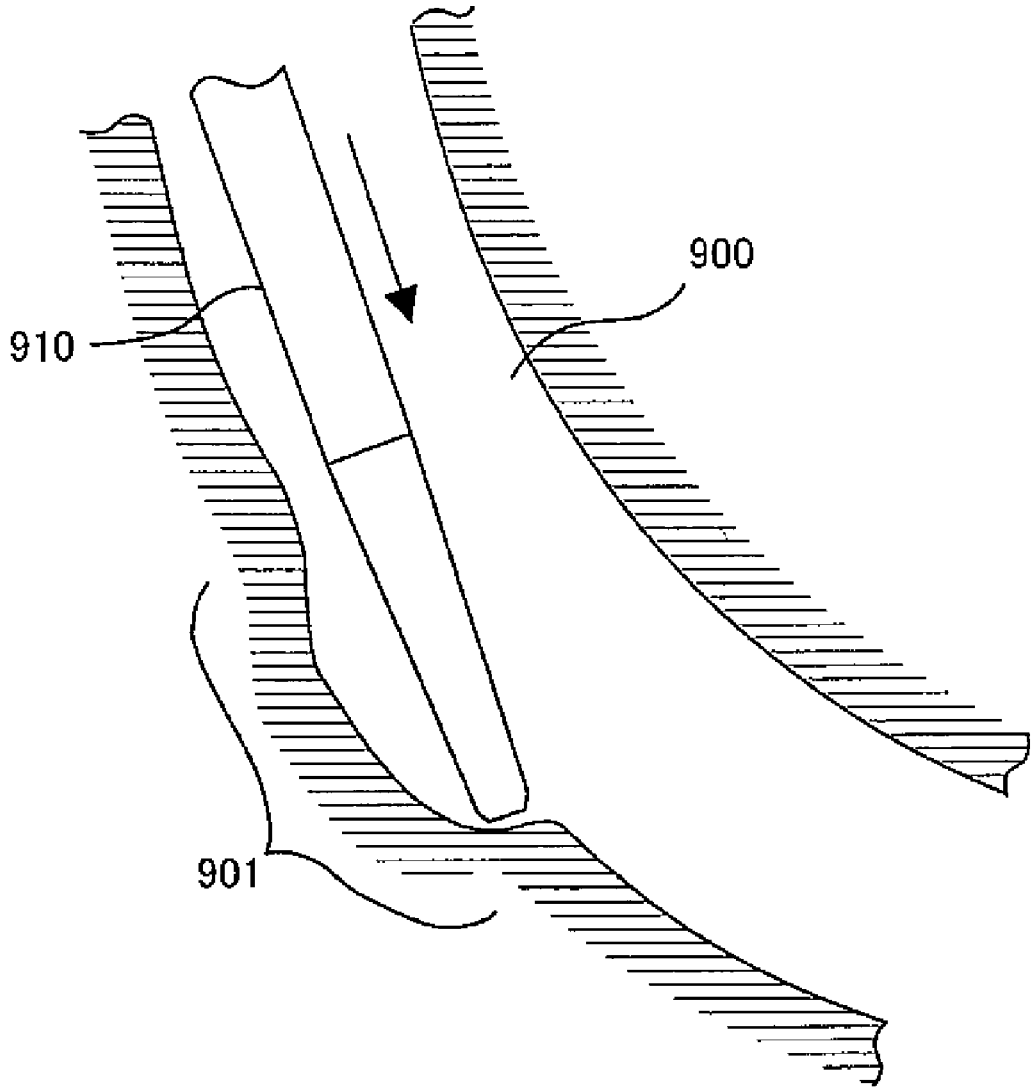
FIG. 1 is a schematic representation of an exemplary hole with a tool deployed in the hole.

Throughout the drawings, identical reference numbers and descriptions indicate similar, but not necessarily identical elements. While the principles described herein are susceptible to various modifications and alternative forms, specific embodiments have been shown by way of example in the drawings and will be described in detail herein. However, it should be understood that the invention is not intended to be limited to the particular forms disclosed. Rather, the invention includes all modifications, equivalents and alternatives falling within the scope of the appended claims.

DETAILED DESCRIPTION

Illustrative embodiments and aspects of the invention are described below. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such development effort might be complex and time-consuming, but would nevertheless be a routine undertaking for those of ordinary skill in the art having the benefit of this disclosure.

Reference throughout the specification to "one embodiment," "an embodiment," "some embodiments," "one aspect," "an aspect," or "some aspects" means that a particular feature, structure, method, or characteristic described in connection with the embodiment or aspect is included in at least one embodiment of the present invention. Thus, the appearance of the phrases "in one embodiment" or "in an embodiment" or "in some embodiments" in various places throughout the specification are not necessarily all referring to the same embodiment. Furthermore, the particular features, structures, methods, or characteristics may be combined in any suitable manner in one or more embodiments. The words "including" and "having" shall have the same meaning as the word "comprising."

Moreover, inventive aspects lie in less than all features of a single disclosed embodiment. Thus, the claims following the Detailed Description are hereby expressly incorporated into this Detailed Description, with each claim standing on its own as a separate embodiment of this invention.

Figure 2:
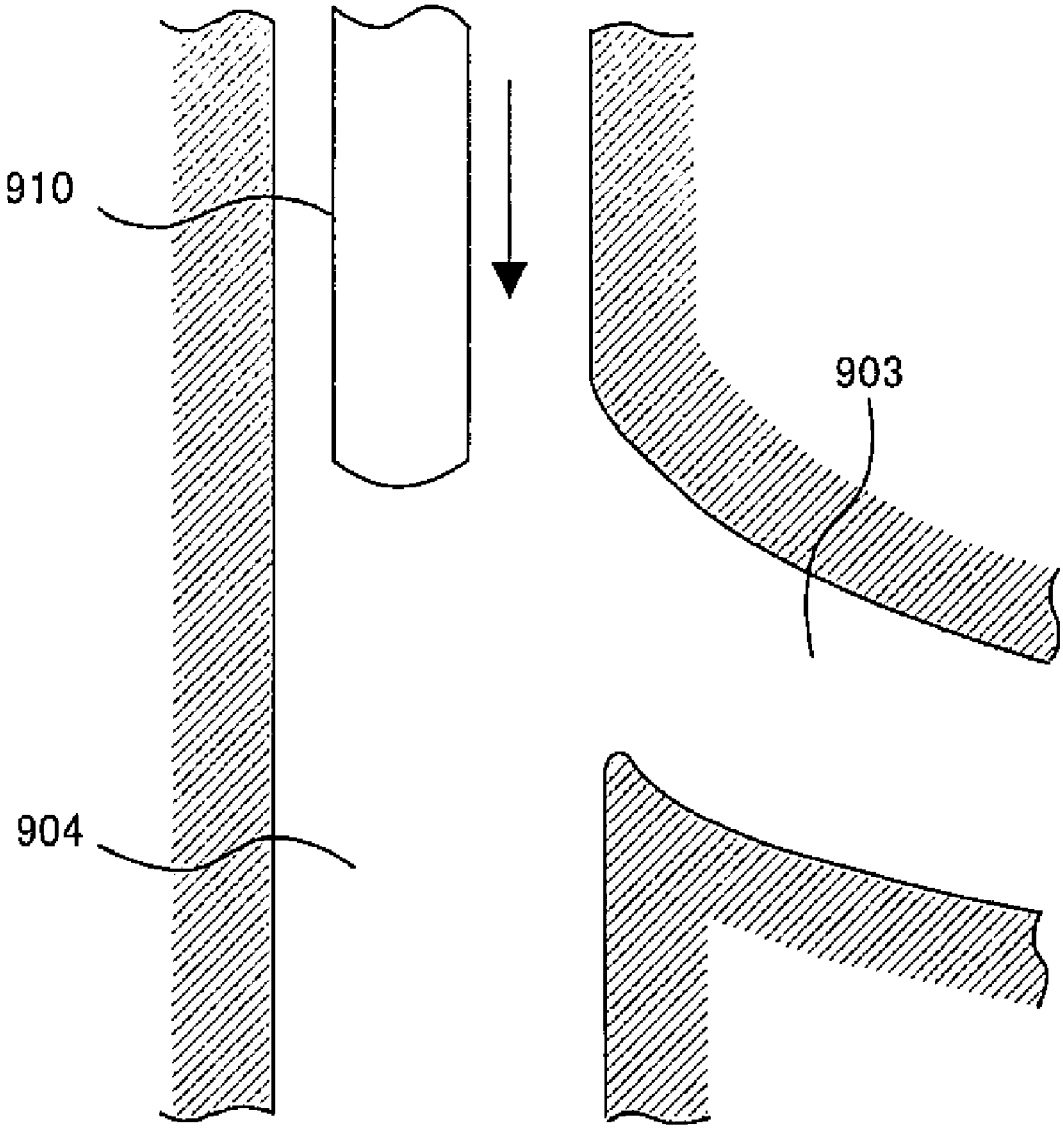
FIG. 2 is a schematic representation of a main hole having a branched lateral hole.

FIG. 1 shows an exemplary case of a highly-deviated hole 900 having an irregular perimeter wall 901. In a case such as depicted in FIG. 1, jamming of a tool 910 at the region 901 is common when the tool 910 is navigated in the hole 900 using conventional techniques. FIG. 2 shows another exemplary case of a lateral hole 903 branched from a main hole 904. In the case depicted in FIG. 2, tool navigation with respect to the lateral branch 903 is difficult using conventional techniques.

Figure 3:
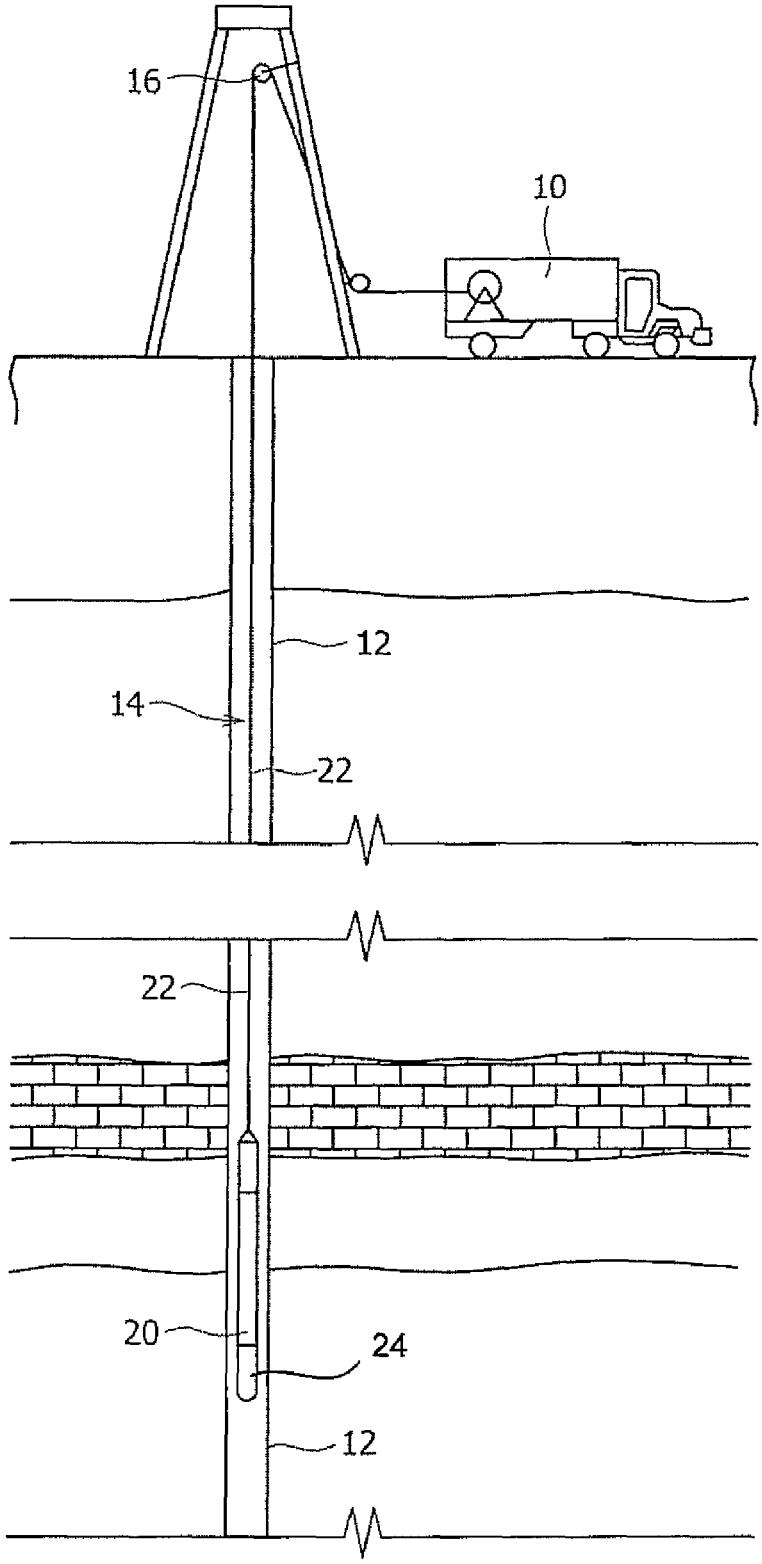
FIG. 3 is a schematic illustration of a system including an exemplary tool that may be navigated downhole according to the principles described herein.

FIG. 3 is a schematic illustration showing a system including an exemplary downhole tool that can be navigated according to the principles described herein. The system of FIG. 3 includes a tool 20 that is navigated within a borehole 14 of a well 12 drilled into the ground. The tool 20 may be deployed using conventional logging cable 22, or by another method of deployment that is consistent with the principles described herein. In this, known modes of deployment such as wireline, coiled tubing, slick line, among others, may be employed according to the principles described herein. Furthermore, the disclosure herein contemplates applications in well services, pipeline monitoring, and similar areas that require tool navigation in conditions where "intelligent" navigation by the tool is desirable. As used herein, "intelligent navigation" refers to tool navigation that is more than a tool that is navigated from the surface; rather, the tool has at least some self-contained navigational abilities that are provided by downhole sensors/sensing mechanism associated with the tool itself in combination with capability to make positional determinations based on data that are provided by the tool sensors/sensing mechanism. In this, in aspects described herein a tool's navigation apparatus may acquire data relating to the profile, for example, shape and configuration, of a subterranean hole by various techniques, such as ultrasonic waves, mechanical calipers, strain gauges, jets of liquid. The acquired hole profile data may be compared with stored hole data that may have previously been acquired by various techniques, such as during drilling, and include data such as hole trajectory, hole configuration, among other data that are known conventionally about a drilled well bore. Such data may further include hole size and depth data relating to locations of lateral holes in the main hole. A target position for the tool may be derived from the comparison between acquired hole data and stored hole data so that the tool can be manipulated, for example, using predetermined commands, to accomplish a "mission profile," such as maintaining a center position in a hole, or entering a lateral branch.

Referring again to FIG. 3, the cable 22 may be looped through a pulley 16 of an oilrig in a known conventional arrangement. The cable 22 also may include transmission lines for data transmission to and from the surface. In this, signals may be transmitted electrically or optically to and from a processing unit (not shown) in a service truck 10, or by any other conventional arrangement, such as telemetry with a remote location. The tool 20 may be navigated in the well 12 by navigation apparatus 24, some embodiments of which are described hereinafter with reference to FIGS. 4 to 15.

Figure 4A:
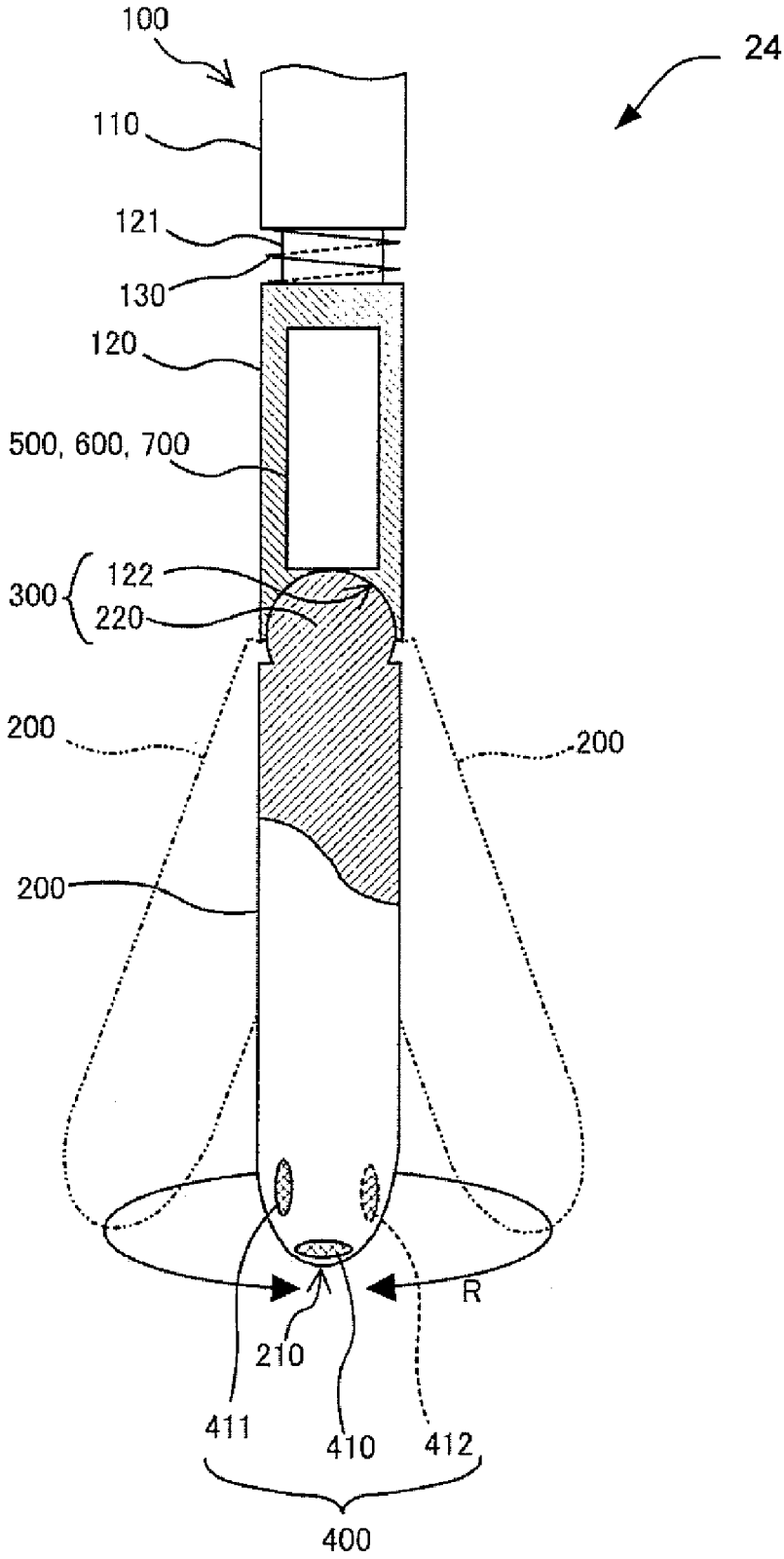
FIG. 4A depicts one embodiment of a downhole tool with one apparatus for navigating the tool in subterranean holes.
Figure 4B:
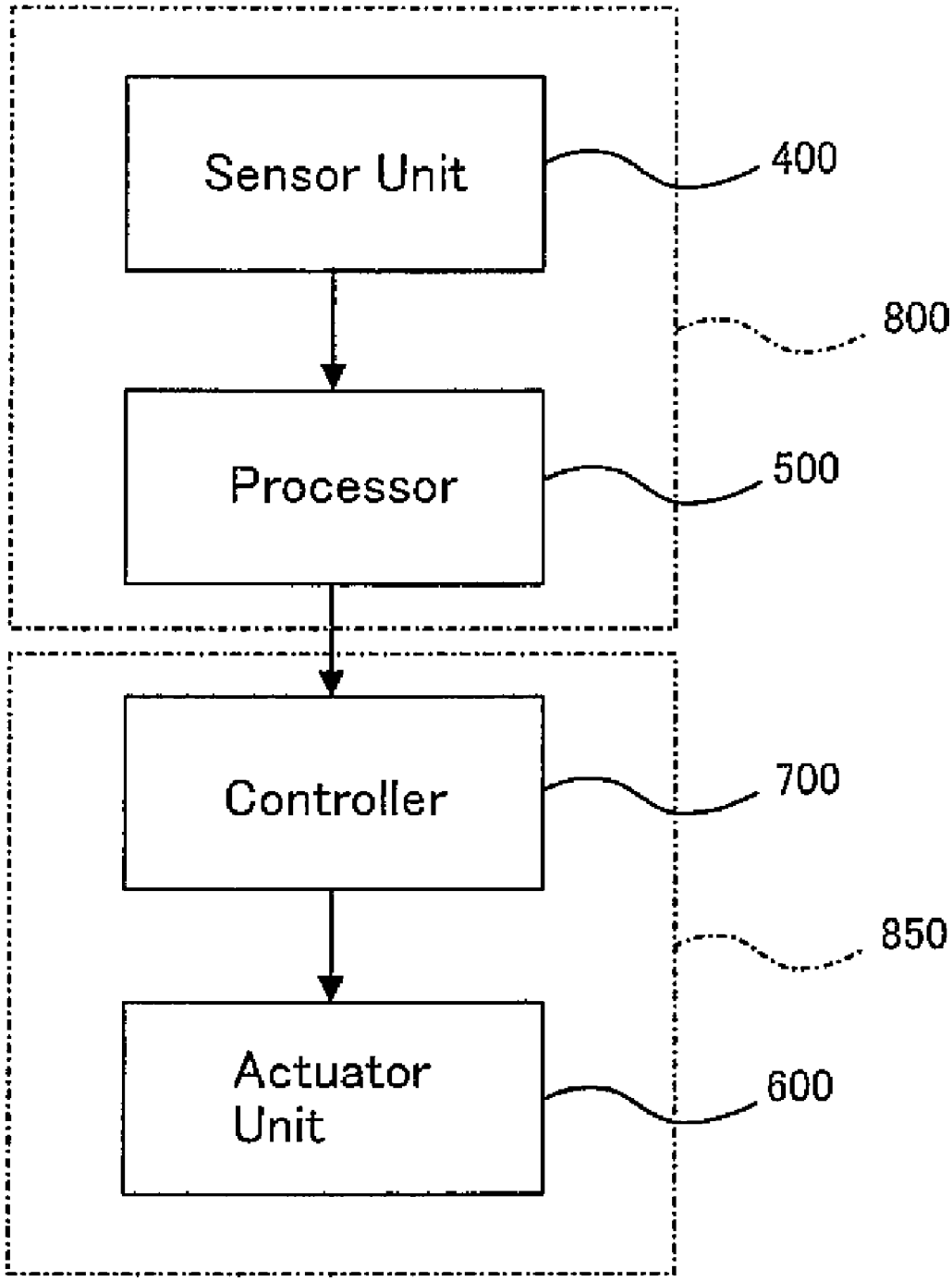
FIG. 4B is a schematic representation of one navigation apparatus for navigating a tool described herein.

FIG. 4A shows one embodiment of a navigation apparatus 24 for navigating a tool. FIG. 4B is a block diagram representation of some elements of one possible navigation apparatus. The navigation apparatus in FIG. 4A includes a body member 100 and a head member 200 steerably associated with the body member 100. The body member 100 has an upper body member 110 and a lower body member 120, which may be connected via a spring 130 as a shock absorber installed on a shaft 121 of the lower body member 120. In the embodiment of FIG. 4A, the body member 100 and the head member 200 are interconnected by an articulating joint mechanism 300 so that head member 200 is able to swing at the articulating joint mechanism 300, as shown by dot-dashed lines in FIG. 4A. The head member 200 may also rotate about the axis of the body member 100 as indicated by "R" in FIG. 4A. By swinging and/or rotating the head member 200, the nose or end 210 of head member 200 may be navigated, i.e., positioned or located, at a predetermined transversal position relative to the tool in the hole.

The articulating joint mechanism 300 may be configured by coupling a spherical concave surface 122 of the lower body member 120 and a convex surface of spherical top portion 220 of the head member 200. Articulation mechanisms such as, for example, described in U.S. Pat. Nos. 5,022,484, 5,727,641, and 6,209,645 also may be used as the articulating joint mechanism 300. The aforementioned United States patents are hereby incorporated herein by reference in their entirety. The lower body member 120 may include a processor 500, an actuator unit 600 and a controller 700, described in more detail below.

A determining unit 800 (note FIG. 4B) may be provided for positional determination with respect to nose 210 of the head member 200 relative to the body member 100. By operations of the determining unit 800, as described below, the nose 210 may be located or directed toward a predetermined transversal position relative to the tool in the hole. As depicted in FIGS. 4A and 4B, the determining unit 800 may include a sensor unit 400 and a processor 500. In one aspect, the sensor unit 400 may be configured or designed to measure at least two transversal distances between nose 210 and points on the hole perimeter surface adjacent to the nose 210. The processor 500 may be configured or designed to derive a target position for the nose 210 based on the measured transversal distances. In another aspect, the sensor unit 400 may be configured or designed to measure a cross sectional profile of the hole perimeter surface adjacent to the nose 210. The processor 500 may be configured or designed to derive a target position for the nose 210 based on the measured cross sectional profile.

In FIG. 4A, the sensor unit 400 may utilize ultrasonic waves reflected from the hole perimeter surface. The sensor unit 400 may include a plurality of ultrasonic sensors 410, 411 and 412 at the nose 210 of head member 200. Each ultrasonic sensor 410, 411 and 412 has a transmitter that transmits ultrasonic waves toward the hole perimeter surface, and a receiver that receives ultrasonic waves reflected from the hole perimeter surface. The ultrasonic sensor 410 is configured for a "look ahead" mode by operation of a forwardly directed ultrasonic probe beam. The ultrasonic sensors 411 and 412 are configured for "look around" mode operation with the ultrasonic probe beams being directed around the axis of the head member 200.

Figure 5:
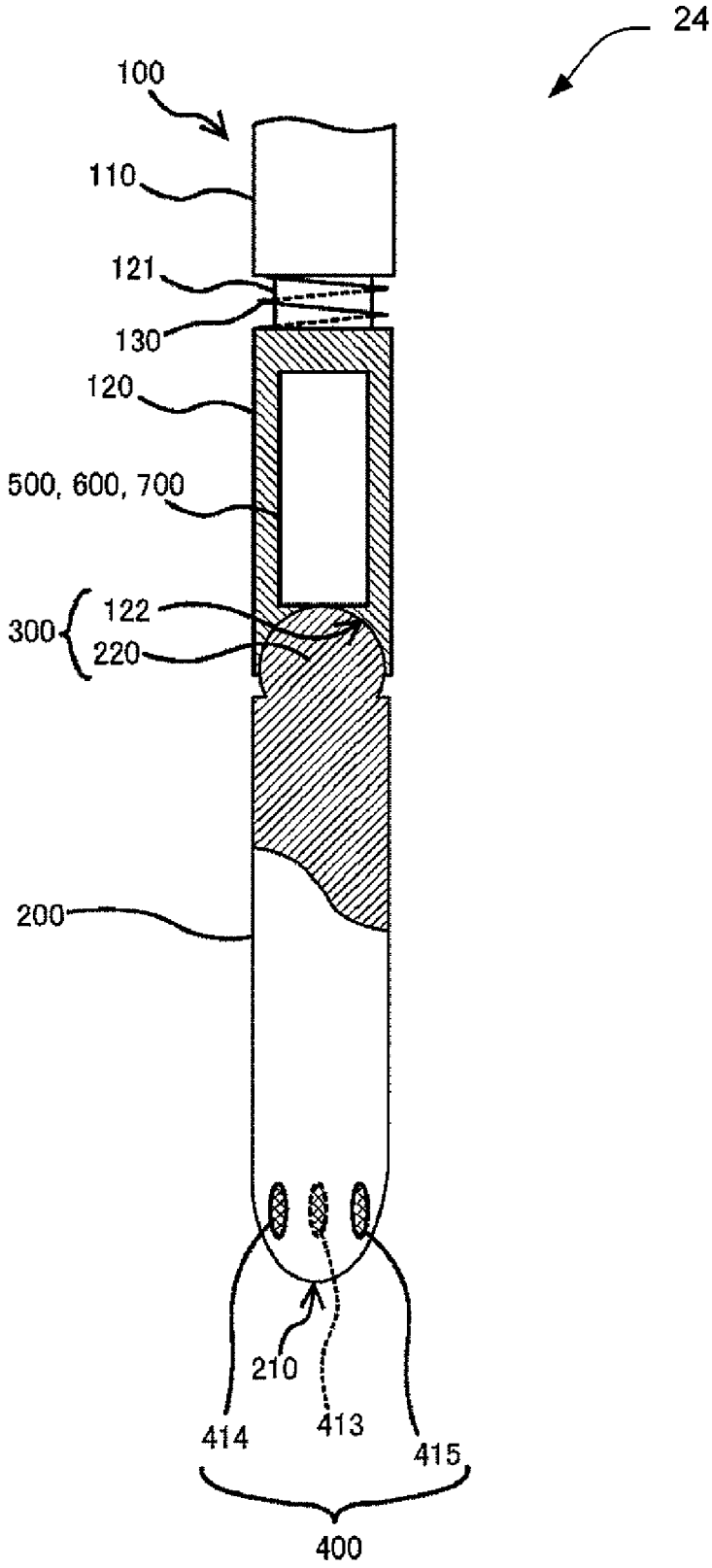
FIG. 5 is a schematic representation of another embodiment of a tool having an apparatus for navigating the tool described herein.
Figure 6A:
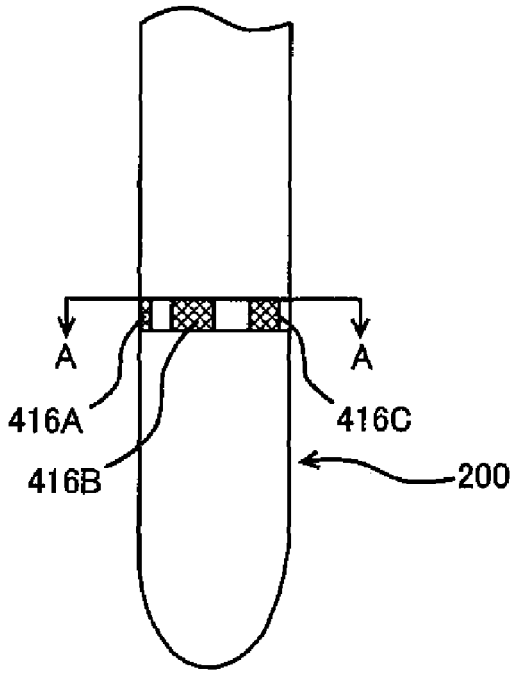
FIGS. 6A and 6B are schematic representations of other apparatus for navigating a tool described herein.
Figure 6B:
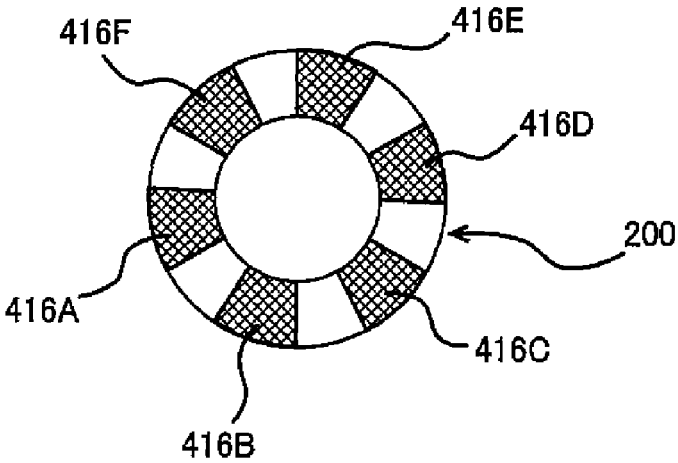

FIG. 5 shows another embodiment of a navigation apparatus having the sensor unit 400 configured with touch sensors located around the periphery of the nose 210 of the head member 200. In this, positional information with respect to the nose 210 may be derived by the sensors 413, 414 and 415 "touching" perimeter surfaces around the head member 200. Any suitable touch sensor that detects contact with objects in the environment around the head member 200 may be utilized according to the principles described herein. Configurations for such sensor arrangements are known by persons skilled in the art. In this, an array of load sensors, such as strain gauges, may be arranged around the peripheral circumference of the nose 210 such that contact with another body, for example, a part of the perimeter of a subterranean hole, causes change in the sensor thereby providing contact/positional information for purposes of navigation as described herein. For example, an array of segmented or embedded piezoelectric sensors may be provided at the nose 210 for purposes of providing positional data to a navigation system according to the principles described herein. FIGS. 6A and 6B show other configurations of the sensor unit 400. For example, the sensors may be configured as a segmented unit (note FIG. 6B) that is disposed at a terminal portion of the head member 200.

Figure 7:
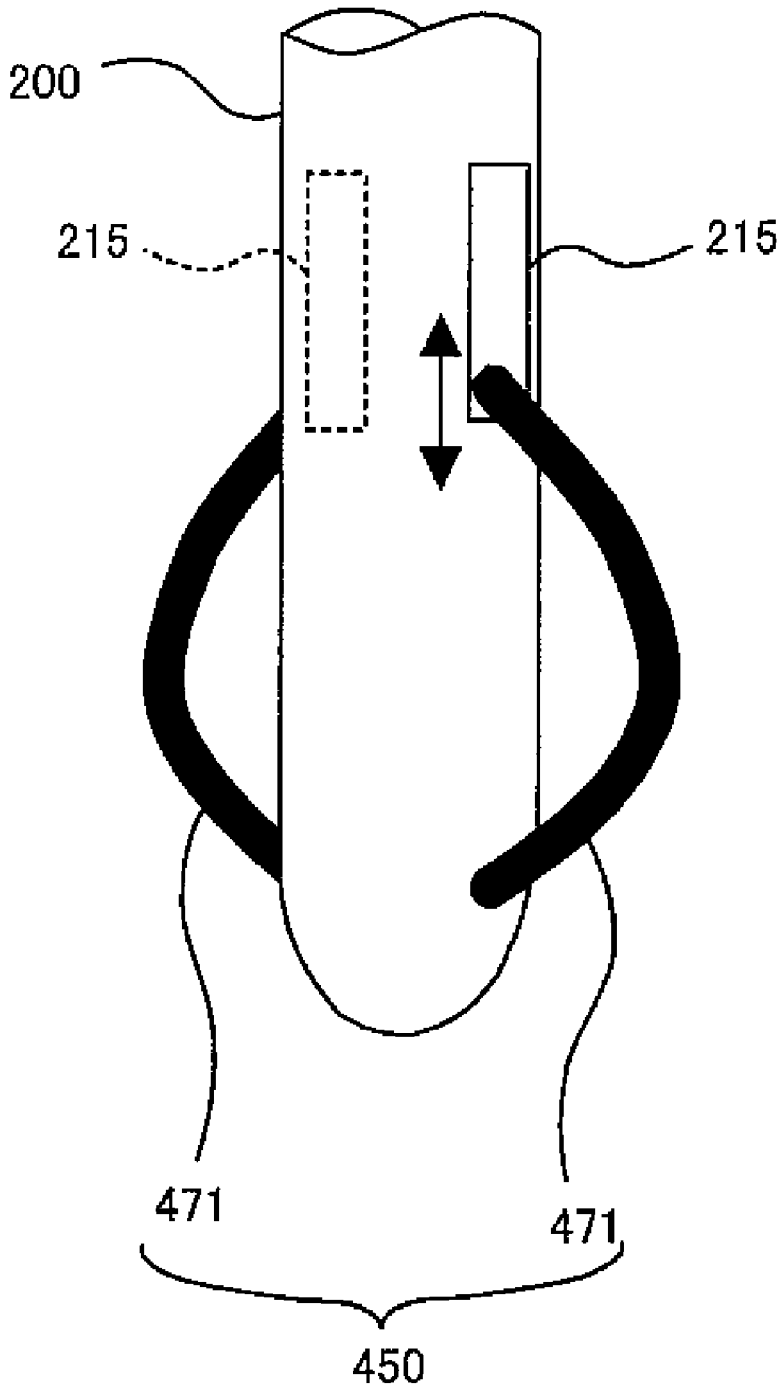
FIG. 7 shows another embodiment of a tool having an apparatus for navigating the tool described herein.
Figure 8:
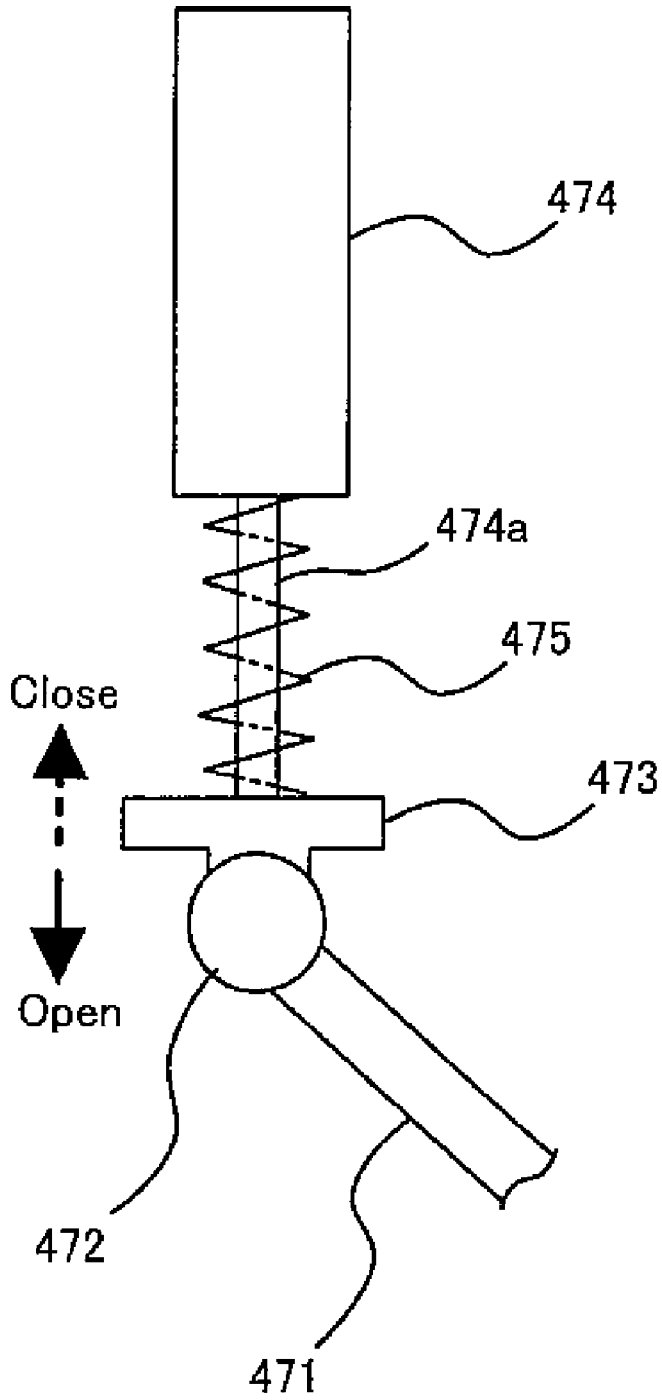
FIG. 8 shows one exemplary mechanism for navigating the tools described herein.

FIG. 7 shows another embodiment of a navigation apparatus having a sensor unit 450. FIG. 8 shows an example of a mechanism for controlling movable arms 471 of the sensor unit 450 in FIG. 7. The sensor unit 450 includes a plurality of movable arms 471. One, two, three or more pairs of arms 471 may be mounted on the head member 200 and configured to be extendable and retractable thereof. The sensor unit 450 may include independently extendable and retractable arms 471, which are extended from corresponding movable rotation joints 472 (note FIG. 8) through apertures 215 provided at the head member 200. A suitable mechanism, such as shown in FIG. 8, may be used to extend each arm 471 so that the arm 471 contacts a portion of the hole perimeter surface. A position sensor 474 may be provided that senses the position of each arm 471. In FIG. 8, the position sensor 474 includes a spring 475 mounted on a plunger 474*a* between the body of the position sensor 474 and a slidable plate member 473 of the rotation joint 472. The position sensor 474 may be configured as a linear position sensor using a magnetic scale and a magnetic detector provided inside the head member 200.

Figure 9A:
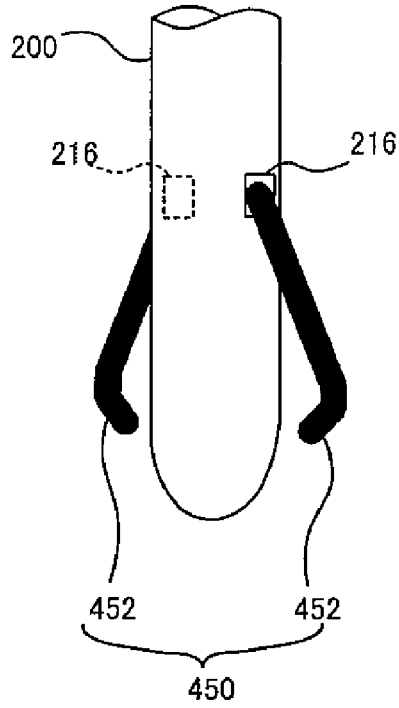
FIGS. 9A and 9B show other exemplary mechanisms for navigating the tools described herein.
Figure 9B:
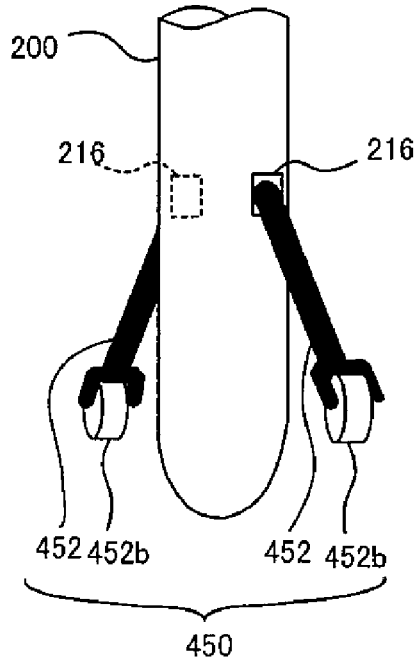
Figure 10:
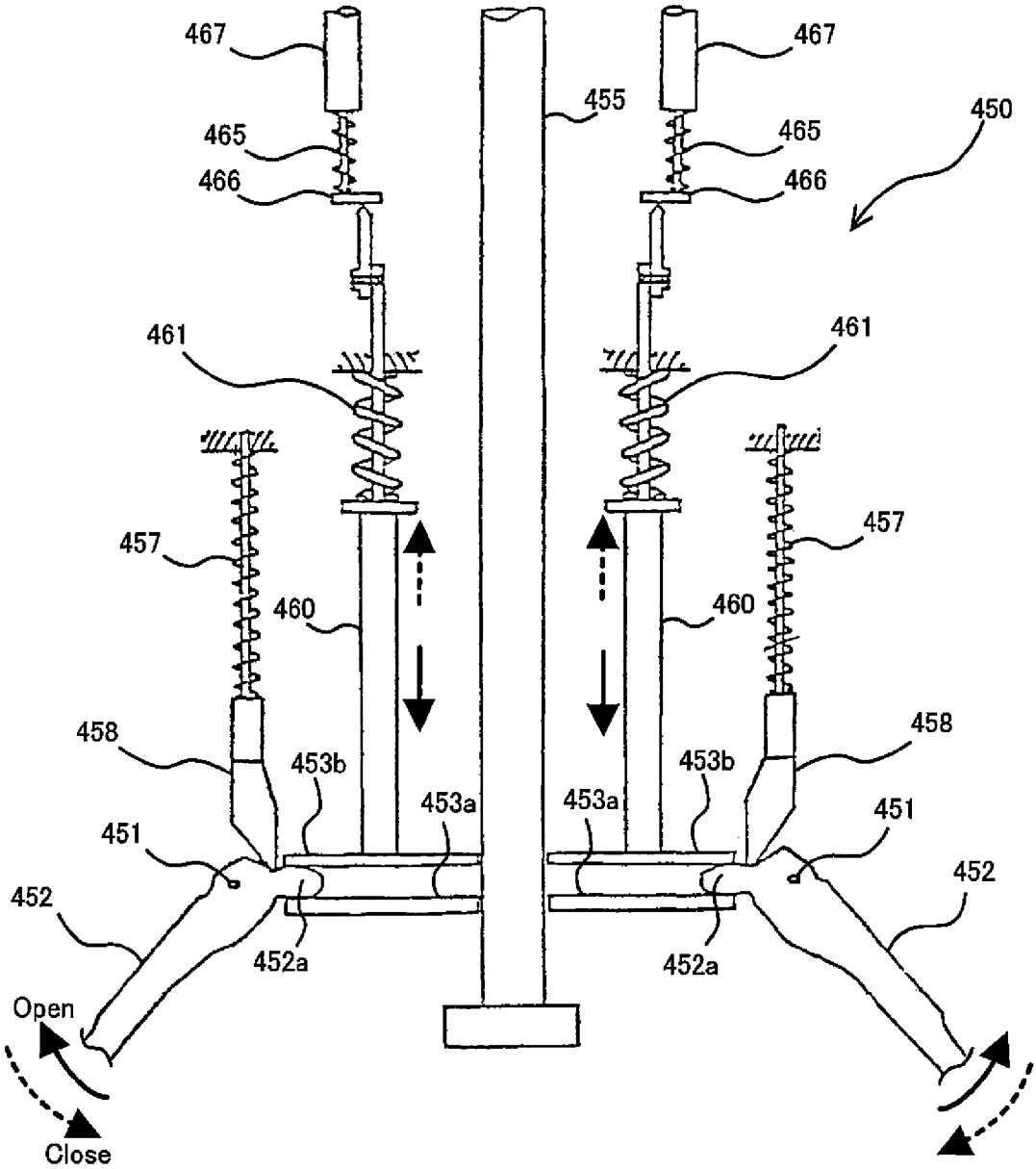
FIG. 10 shows yet another example of a mechanism for navigating the tools described herein.

FIGS. 9A and 9B show other exemplary sensor units 450 having arms 452 extending through apertures 216 of the head member 200. FIG. 10 shows an example of a mechanism for controlling movement of arms shown in FIGS. 9A and 9B. The sensor units 450 in FIGS. 9A and 9B may include independently extendable and retractable arms 452, which are extended from rotation axes 451 (note FIG. 10) through apertures 216 of the head member 200. In FIG. 9A, the terminal portion of arm 452 has a curved structure so as to smoothly trace the perimeter surface without interference. The terminal portion of arm 452 may include a rotor member 452*b*, as shown in FIG. 9B, so that the terminal portion of arm 452 can roll over the perimeter surface.

Referring to FIG. 10, the inner end 452*a* of arm 452 is clamped between two movable plates 453*a* and 453*b*. The plates 453*a* and 453*b* can be moved along a base shaft 455 that passes through center holes of the plates 453*a* and 453*b*. The inner end 452*a* of arm 452 is biased beside the clamped portion by a spring 457 and a push rod 458 so as to provide opening force for the arm 452. A shaft 460 is connected on the upper surface of the upper clamp plate 453*b* that is biased downward by a spring 461 so as to hold the upper clamp plate 453*b* in contact with the inner end 452*a* of arm 452. The upper end of shaft 460 is in contact with end plate 466, which is connected to a rod of the position sensor (for example, potentiometer or other position sensor) 467. Spring 465 holds the end plate 466 in contact with the shaft 460.

The processor 500 may be, for example, a digital signal processor that derives the target position based on output from the sensor unit 400, 450. The processor may be associated with a suitable electronic storage device, such as memory, in which previously acquired data with respect to a subterranean hole may be stored. For example, stored data, such as hole trajectory and hole configuration, may be used by processor 500 to derive the target position. In this, the processor 500 receives acquired hole profile data as output from the sensor unit 400, 450, which is configured to "scan" the hole perimeter surfaces as described herein, and stored profile data from the associated memory device to thereby derive a target position based upon a "mission" for the tool.

The navigation apparatus also includes a steering unit 850 (see FIG. 4B) that comprises an actuator unit 600 and a controller 700. The actuator unit 600 is configured to manipulate the head member 200 to change the relative position of the nose 210 of the head member 200 with respect to the body member 100 in a transversal direction thereof. The controller 700 is configured to control the actuator unit 600 so that the nose 210 may be guided to and located at a target position determined by the determining unit 800, as described above. In this, the target position derived by the determining unit 800 is provided to the controller 700, which controls the actuator unit 600 based on the determined target position, so that the head member 200 is manipulated to move the nose 210 to the target position. In aspects described herein, previously stored commands may be executed to manipulate the head member 200 based on the results of the determining unit 800. For example, if the results of the determining unit 800 are a possible tool jamming in a washout, a previously stored command may manipulate the head member 200 to move transversally by a predetermined amount so as to avoid the washout.

Figure 11:
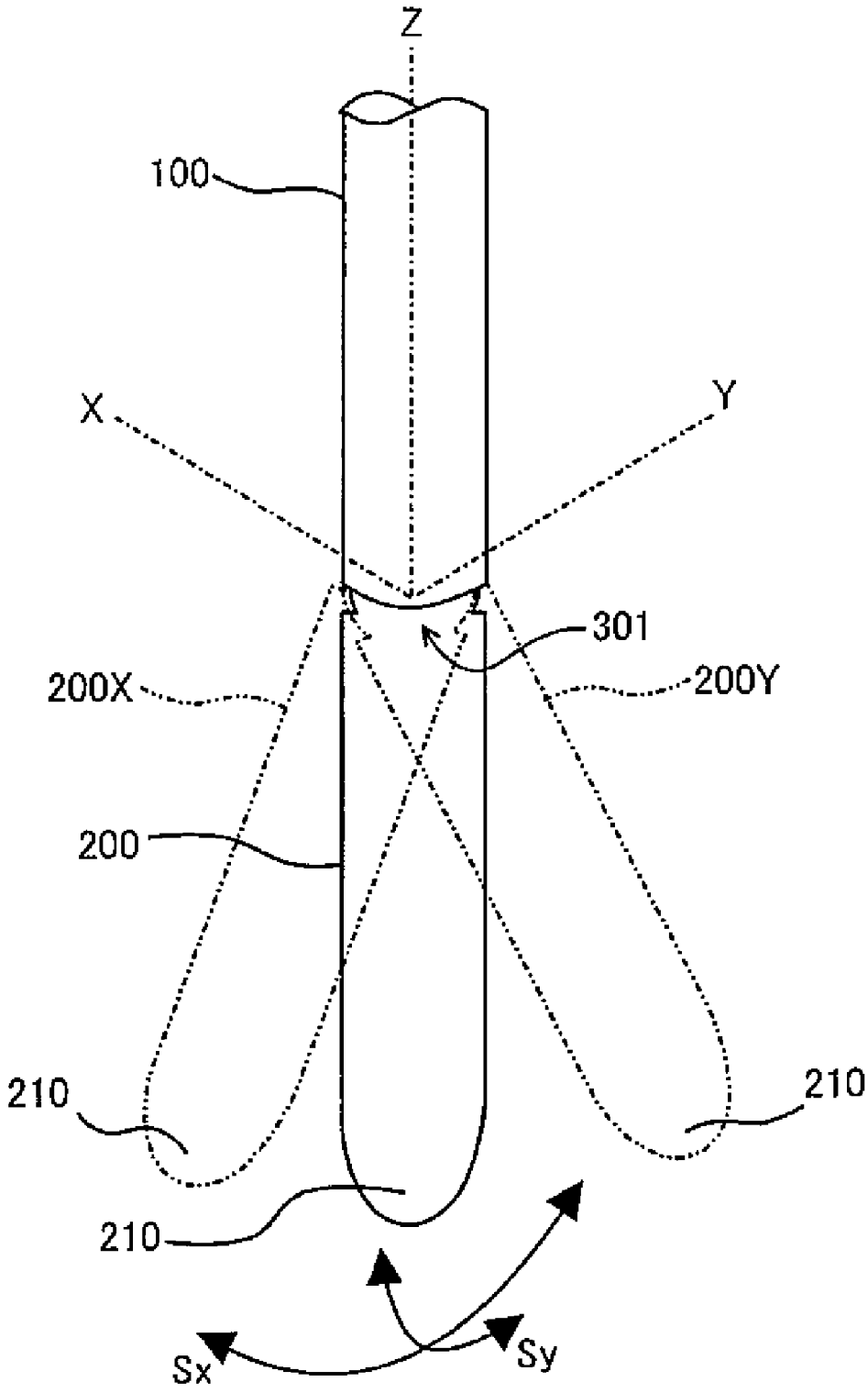
FIG. 11 is a perspective illustration of one tool movement described herein.
Figure 12:
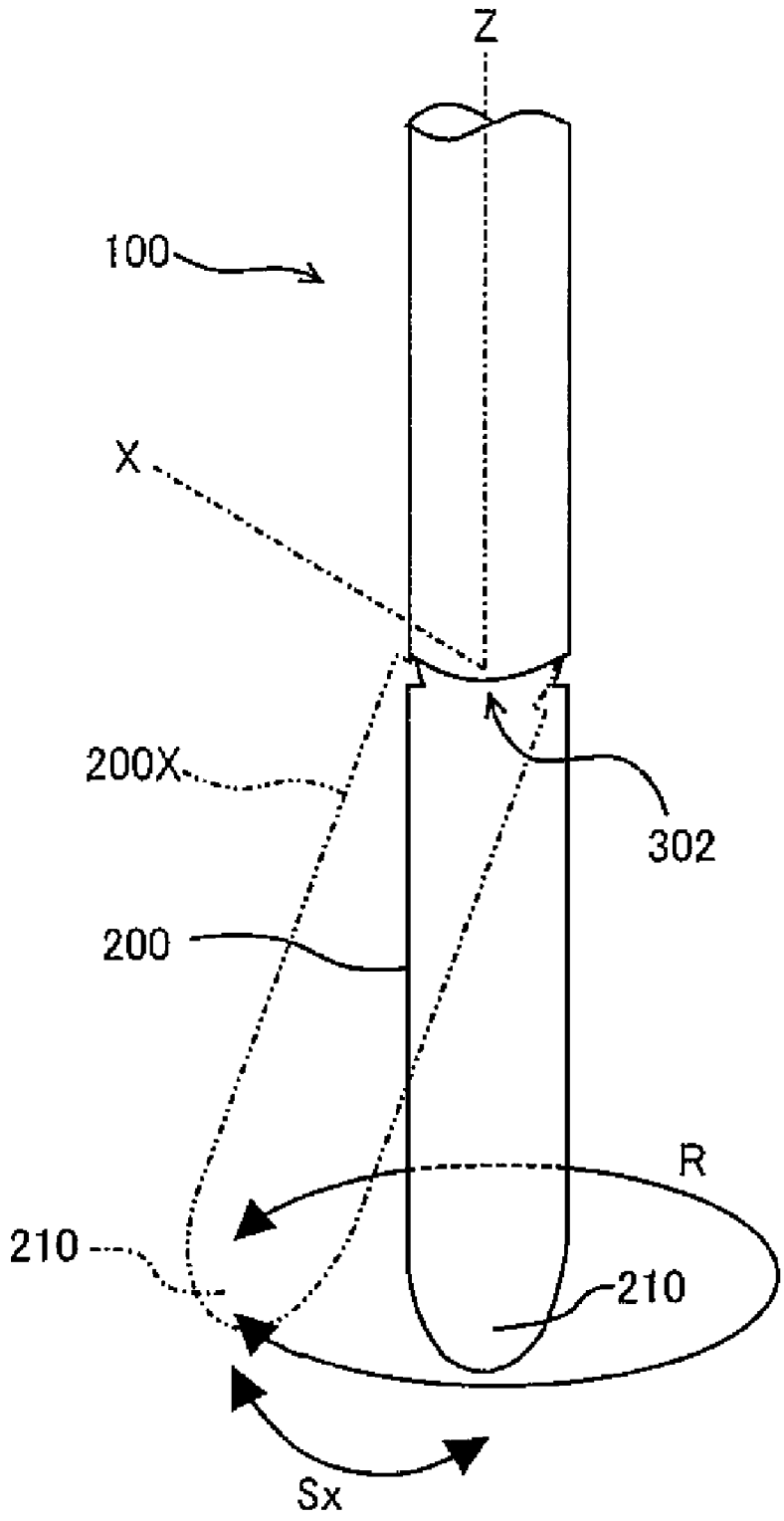
FIG. 12 is a perspective illustration of another tool movement described herein.

FIGS. 11 and 12 illustrate exemplary tool movements based on the principles described herein. FIG. 11 shows one possible double-swing movement of the head member 200. The head member 200 may be provided at a terminal end of the body member 100 and interconnected with the body member 100 by an articulation mechanism 301. In the embodiment of FIG. 11, the head member 200 is configured to swing about axes X and Y by predetermined swing angles +/−θ degrees, as indicated by arrows Sx and Sy, so that the nose 210 may be directed to and located at any desired position in a hemispherical area defined by the predetermined swing angles. In this, the maximum swing angle θ may be set at any appropriate or desired angle, such as +/−30, 45 or 60 degrees. By performing a combination of two swings, the nose 210 of the head member 200 can be directed to a target position on a virtual hemispherical plane.

FIG. 12 shows other possible movements of the head member 200 in which, by a combination of swinging and rotating actions, the head member 200 may be manipulated and guided according to the principles disclosed herein. The head member 200 may be located at a terminal end of the body member 100 and configured with a pivoting mechanism 302 which is provided between the body member 100 and the head member 200. In the embodiment of FIG. 12, the head member 200 is configured to swing about an axis X by predetermined swing angles +/−θ degrees, as indicated with arrow Sx, so that the nose 210 may be manipulated and directed to any desired position in a half-arc area thereof. The maximum swing angle θ is set at any appropriate angle, such as +/−30, 45 or 60 degrees. After swinging the head member 200, rotation of the head member 200 about the center axis Z of the body member 100 by +/−180 degrees in right-hand or left-hand directions, as indicated with "R" in FIG. 12, may be used to suitably manipulate the head member 200 so that the nose 210 reaches a predetermined target position. By performing the rotation and the swing in a predetermined manner, the nose 210 of the head member 200 may be directed to a desired target position on a virtual hemispherical plane around the head member 200.

Figure 13:
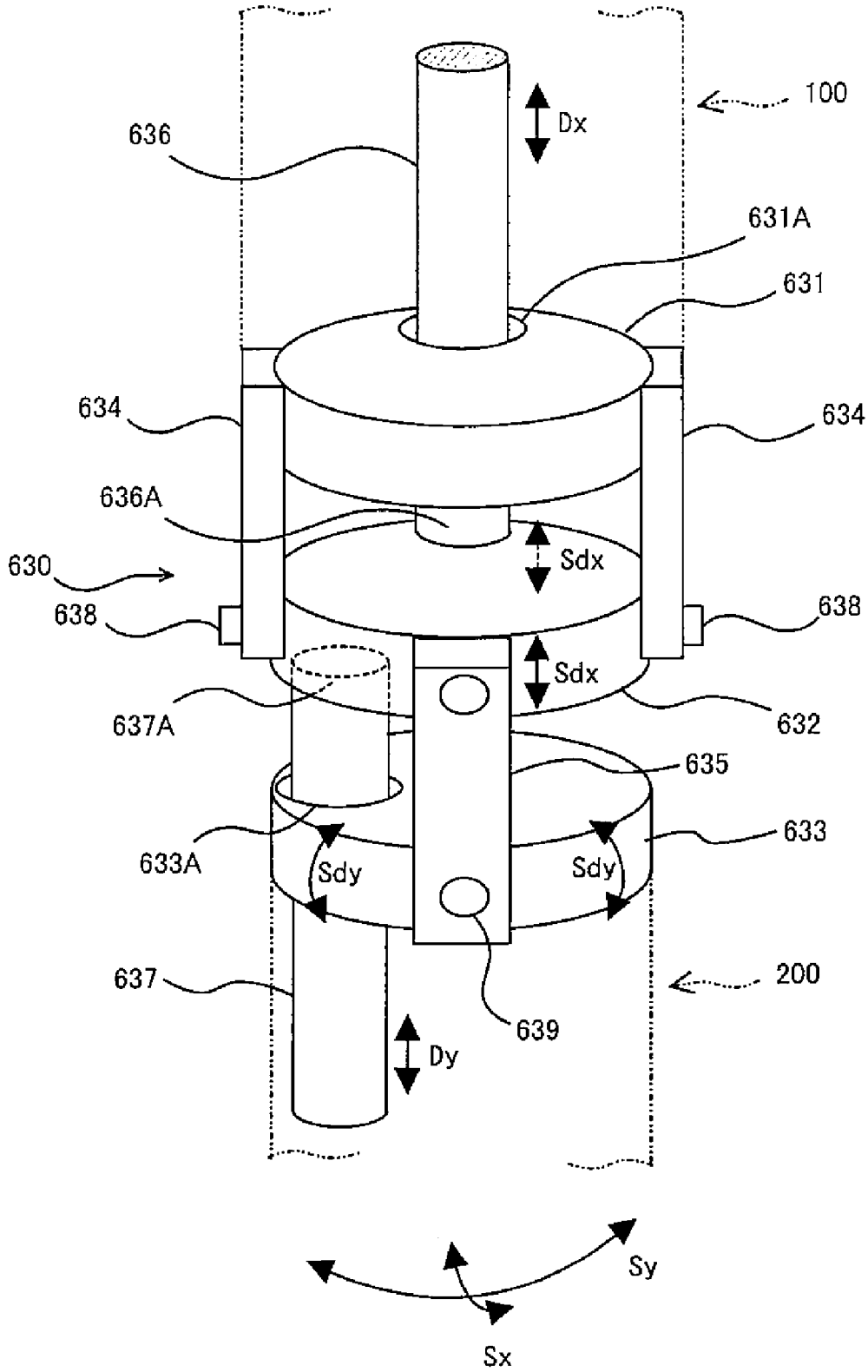
FIG. 13 illustrates one embodiment of an actuator unit described herein.

FIG. 13 shows one embodiment of an actuator unit that may be utilized for the operations described above in connection with FIG. 11. Actuator unit 630 includes an upper disc 631, a middle disc 632 and a lower disc 633, which are arranged at appropriate distances along an axis of the body member 100, with the upper disc 631 and the middle disc 632 being connected with side link arms 634 and the middle disc 632 and the lower disc 633 being connected with side link arms 635, as illustrated in FIG. 13. The side link arms 634 and 635 may be disposed on circumferential parts of the middle disc 632 with a 90 degrees separation between adjacent arms. The upper disc 631 and side link arms 634 may be fixed to the body member 100 and a drive shaft 636 provided that passes through an eccentered hole 631A in the upper disc 631 with one end 636A in contact with the upper surface of the middle disc 632 at an eccentered position thereof. Another end of the drive shaft 636 may be configured with a suitable a drive apparatus, such as a solenoid in the body member 100, so that the drive shaft 636 can be moved, as indicated by arrow Dx in FIG. 13. The lower disc 633 and side link arms 635 may be fixed to the head member 200 and a drive shaft 637 provided that passes through an eccentered hole 633A in the lower disc 633 with end 637A thereof in contact with the lower surface of the middle disc 632 at an eccentered position thereof. Another end of the drive shaft 637 may be configured with a drive apparatus, such as a solenoid in the head member 200, so that the drive shaft 637 may be moved, as indicated by arrow Dy in FIG. 13. Ball screw mechanisms may be used for the foregoing drive apparatus. The middle disc 632 may be pivotably connected with the side link arms 634 using pivots 638 and the lower disc 633 may be pivotably connected with the side link arms 635 by pivots 639. By driving the drive shafts 636 and 637, as indicated by arrows Dx and Dy in FIG. 13, the middle disc 632 and the lower disc 633 may be manipulated so that a double-swing movement of the head member 200 is obtained, as indicated by arrows Sx and Sy in FIGS. 11 and 13.

Figure 14A:
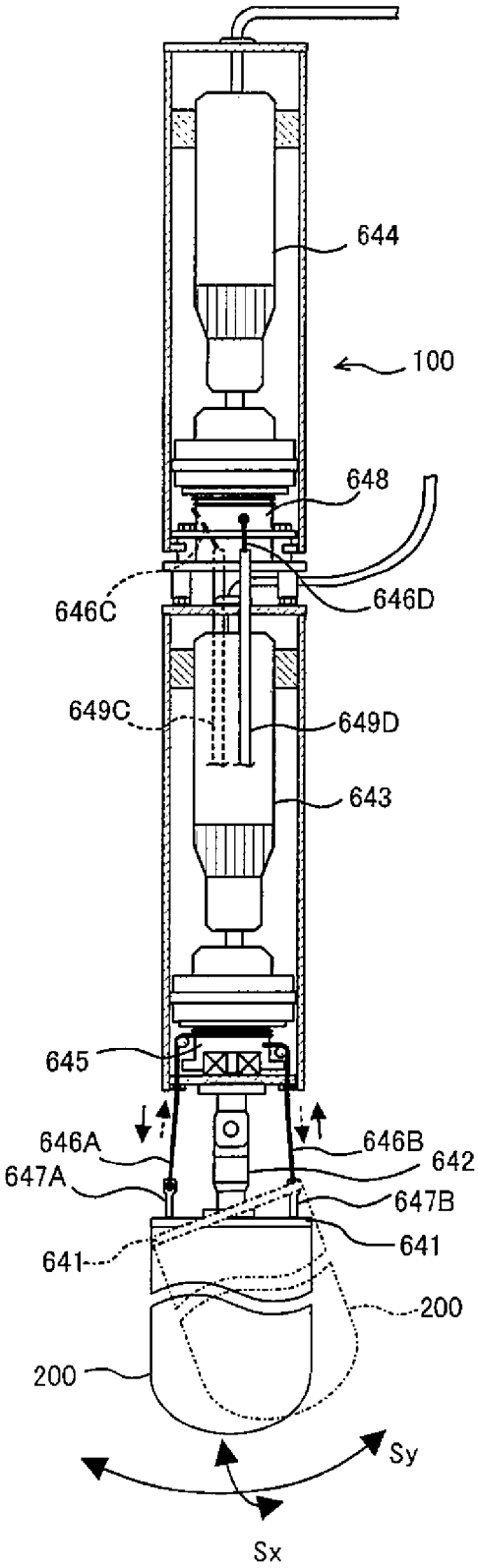
FIGS. 14A to 14C illustrate another embodiment of an actuator unit described herein.
Figure 14B:
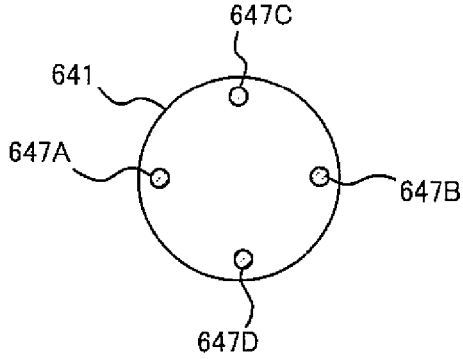
Figure 14C:
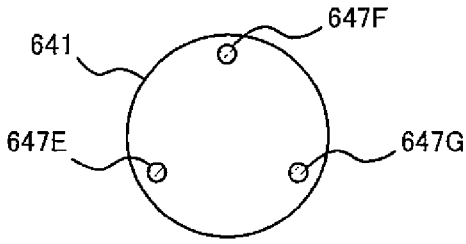

FIGS. 14A and 14B show another embodiment of an actuator unit that may be used for movement of the head member 200 as described above in connection with FIG. 11. In FIG. 14A, the actuator unit includes a swing plate 641 and two sets of drive mechanisms for swinging the plate 641. The swing plate 641 may be disposed on the head member 200 and suspended from the body member 100 by a jointed link 642. The drive mechanisms may be provided in the body member 100 and include two drive motors 643 and 644. The lower drive motor 643 may be used for rotating a drum 645 around which two wires 646A and 646B are wound. The lower ends of wires 646A and 646B may be connected to respective hooks 647A and 647B on the swing plate 641. The hooks 647A and 647B may be fixed at circumferential portions of the swing plate 641, as illustrated in FIGS. 14A and 14B. The upper drive motor 644 may be used for rotating another drum 648 around which two wires 646C and 646D are wound. The lower ends of wires 646C and 646D may be connected, via respective link rods 649C and 649D, to respective hooks 647C and 647D on the swing plate 641 (see FIG. 14B). The hooks 647C and 647D may be fixed at circumferential portions on the swing plate 641 and separated from adjacent hooks 647A and 647B by 90 degrees, as depicted in FIG. 14B. The link rods 649C and 649D are slidably mounted in the body member 100 so as to be able to slide upward and downward. By rotating each wire drum 645 and 648 independently, by the corresponding drive motor 643 and 644, the head member 200 with the swing plate 641 may be swung so that a double-swing movement of the head member 200 is obtained, as indicated by arrows Sx and Sy in FIGS. 11 and 14A. In other possible embodiments, the actuator unit of FIG. 14A may be configured so that the swing plate 641 has three hooks 647E, 647F and 647G thereon, as shown in FIG. 14C, and three wires connected to the hooks 647E, 647F and 647G, respectively, may be driven by associated motors as described above.

Figure 15:
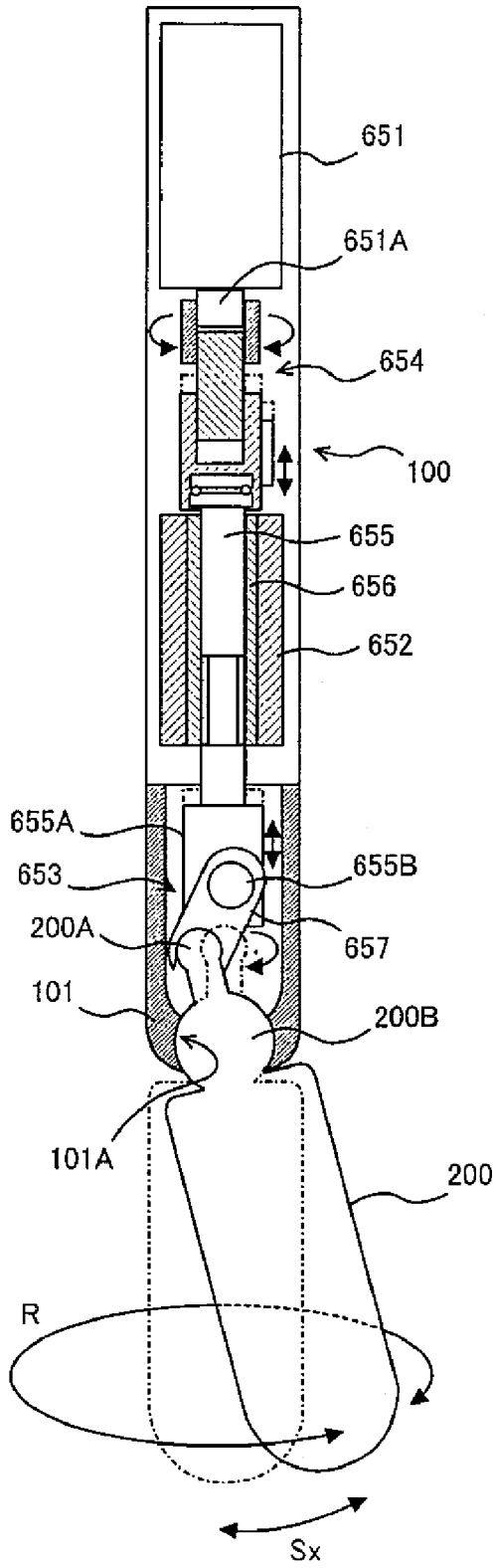
FIG. 15 shows another embodiment of an actuator unit described herein.

FIG. 15 shows yet another embodiment of an actuator unit that may be used for movement of the head member 200 as described above in connection with FIG. 12. As illustrated in FIG. 15, the actuator unit includes two motors 651, 652 and a cam mechanism 653 for swinging the head member 200. The shaft 651A of the upper motor 651 is coupled with a ball screw mechanism 654. By rotating the shaft 651A of the upper motor 651, the drive mechanism 654 may be moved up and down with respect to the body member 100. One end of the drive mechanism 654 may be connected with a main drive shaft 655, which is assembled in the hollow shaft of motor 652 via a ball spline bearing 656. The cam mechanism 653, which includes a cam member 657, may be provided at the lower end portion 655A of the main drive shaft 655. The upper end portion of the cam member 657 is coupled with a pivot axis 655B of the lower end portion 655A so that the cam member 657 can swing about the pivot axis 655B. The lower end portion of the cam member 657 has a spherical concave surface that fits with a spherical convex surface of the top portion 200A of the head member 200. A bulbous portion 200B of the head member 200 may be retained by casing 101 of the body member 100. The bulbous portion 200B of the head member 200 is grasped by the shaped surface 101A of a bottom aperture in the casing 101 of the body member 100 such that the bulbous portion 200B can rotate freely in the aperture. In operation, the upper motor 651 moves the main drive shaft 655 so that the head member 200 is swung, as indicated by arrow Sx in FIGS. 12 and 15. By rotating the main drive shaft 655 with the hollow shaft motor 652, the head member 200 can be rotated, as indicated by arrow R in FIGS. 12 and 15.

Figure 16:
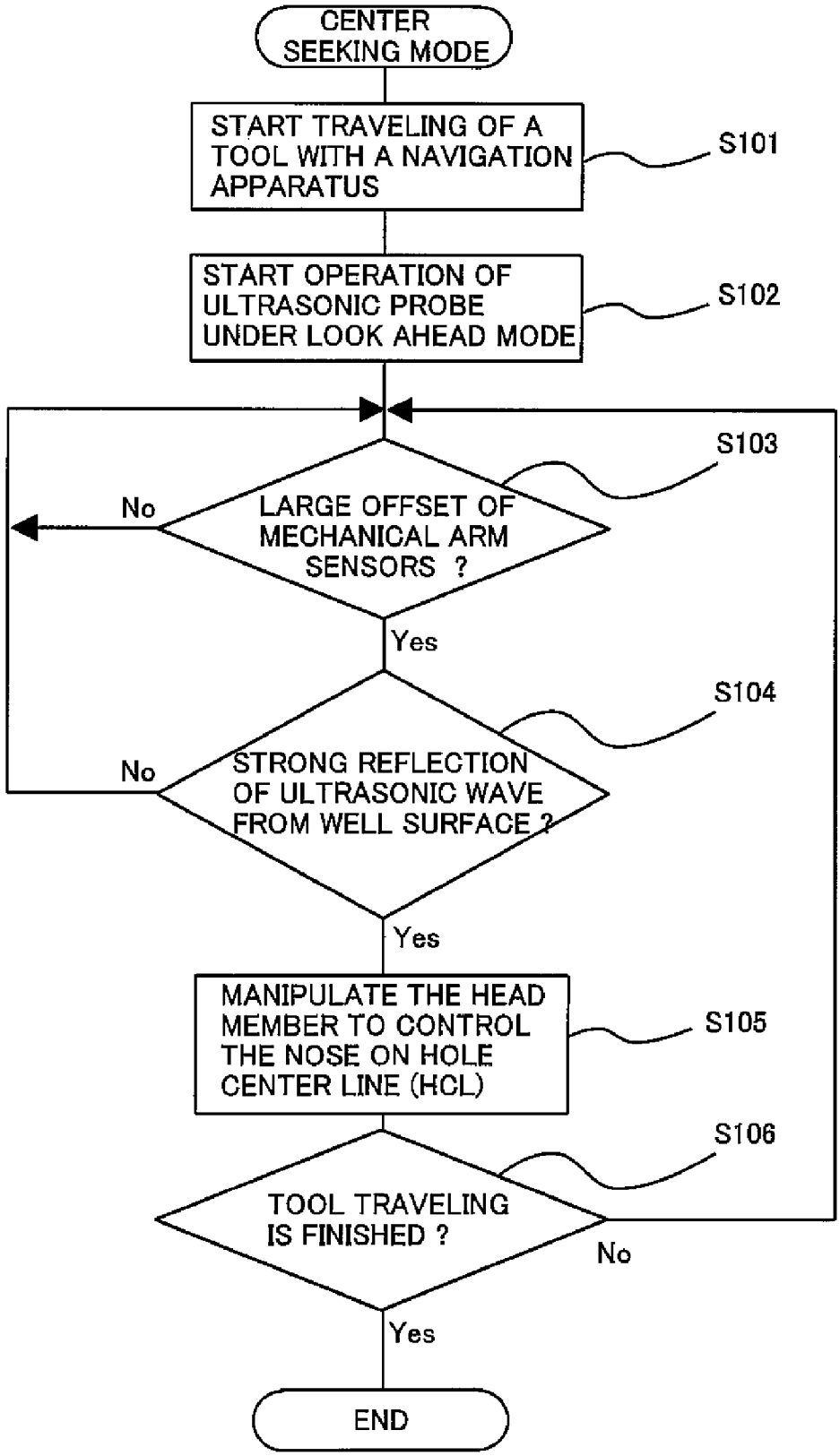
FIG. 16 is a flow chart depiction of one mode of operation described herein.
Figure 17A:
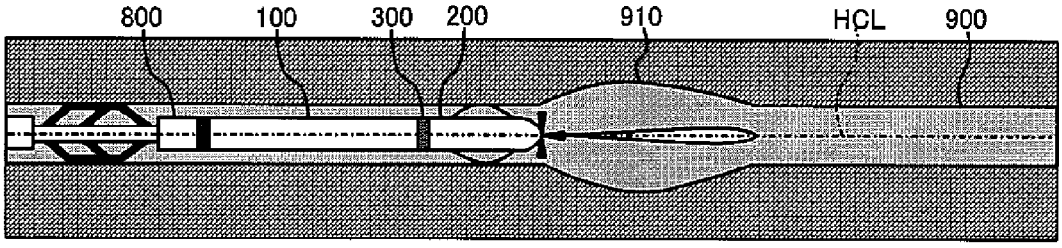
FIGS. 17A to 17D illustrate exemplary tool navigation downhole.
Figure 17B:
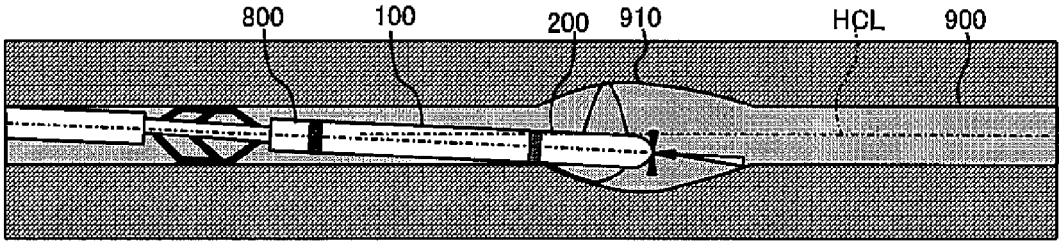

FIG. 16 is a flow chart of one navigation mode described herein. FIGS. 17A to 17D illustrate one exemplary case of tool navigation downhole in which a subterranean tool is navigated in the center of a hole. In the example shown in FIGS. 17A to 17D, sensors such as ultrasonic probe sensors and mechanical arm sensors described herein may be used to navigate the tool 800. The ultrasonic probe sensor may operate in a look-ahead mode as previously described. The tool 800 with the navigation apparatus may be moved along a horizontal open hole 900, as shown in FIGS. 17A to 17D. When the tool 800 travels in a relatively straight portion of the hole 900 with an almost regular inner diameter, as shown in FIG. 17A, the nose of the tool 800 maintains an almost constant path along an estimated center line of the hole (HCL), as shown by a dashed line in FIG. 17A, and the ultrasonic probe sensors do not pick up strong reflection signals from the surface of the perimeter wall of the hole 900. However, when the nose of the head member 200 reaches an indented area 910, with a diameter that is greater than the adjacent areas of the hole 900 as shown in FIG. 17B, the nose of the head member 200 has a large offset from the estimated HCL and the mechanical arm sensors determine a significant deviation from the center line. Also, the ultrasonic probe sensors under the look-ahead mode detect strong reflections of ultrasonic waves from inner surfaces of the indented area 910. Based on data received from the mechanical arm sensors and the ultrasonic probe sensors, the head member 200 is manipulated so that:

(1) the offset error of the nose position from the estimated HCL is minimized, (2) the mechanical arm sensors indicate minimum deviation of the head member from the center line, and (3) reflections of ultrasonic waves from the inner surfaces of hole that are detected by the ultrasonic probe sensors are minimized.

Figure 17C:
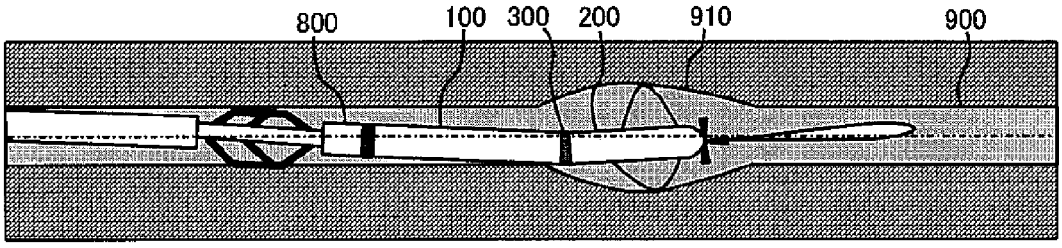
Figure 17D:
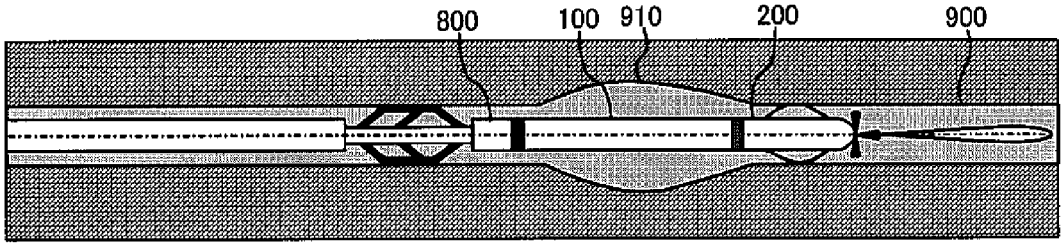

By controlling the position of the nose of the head member 200, with manipulation of the head member 200 as previously described herein, the head member 200, and consequently the tool 800, may be navigated so as to maintain a downhole course that is substantially along the estimated HCL, as shown in FIG. 17C. In this, the head member 200 is pivoted about the articulation mechanism 300 (note also FIGS. 4A and 5). As a consequence of the navigation described above, the tool 800 is navigated so as to avoid jamming as a result of the indentation 910, and is able to move forward into a straight area of the hole 900, as shown in FIG. 17D.

Figure 18:
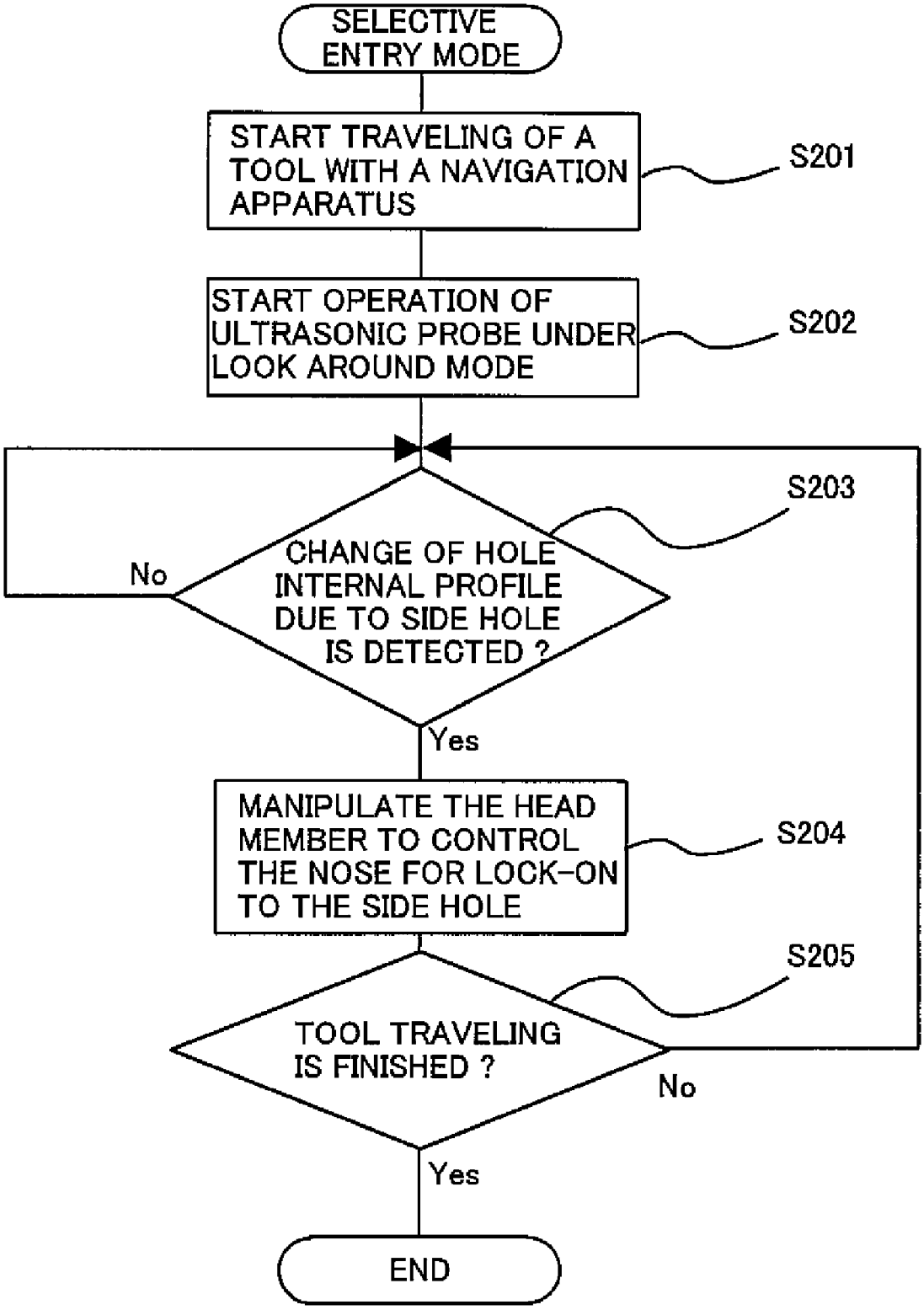
FIG. 18 is a flow chart depiction of another mode of operation described herein.

FIG. 18 illustrates another mode of operation of a subterranean tool according to the principles described herein. FIGS. 19A to 19D depict navigation operations that may be used for conveying a tool 800 into a side-hole or lateral branch 905 of a main hole 906 using a mode described herein as "selective entry mode." In the example depicted in FIGS. 19A to 19D, ultrasonic probe sensors and mechanical arm sensors may be configured as previously described herein, with the ultrasonic probe sensors configured to operate in a look-around mode. The tool 800 with the navigation apparatus is navigated along the main hole 906, as previously described, and guided so as to enter the side-hole 905 that is branched from the main hole 906, as shown in FIGS. 19A to 19D. When the tool 800 is in an area of the hole 906 that is straight, i.e., with a diameter that is generally constant as shown in FIG.

Figure 19A:
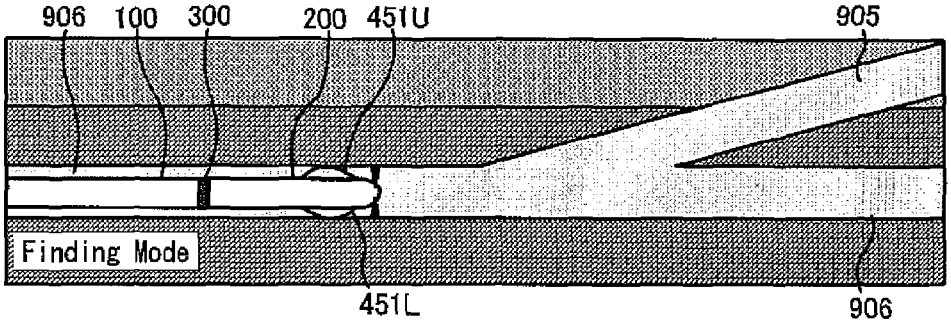
FIGS. 19A to 19D illustrate another exemplary tool navigation downhole.
Figure 19B:
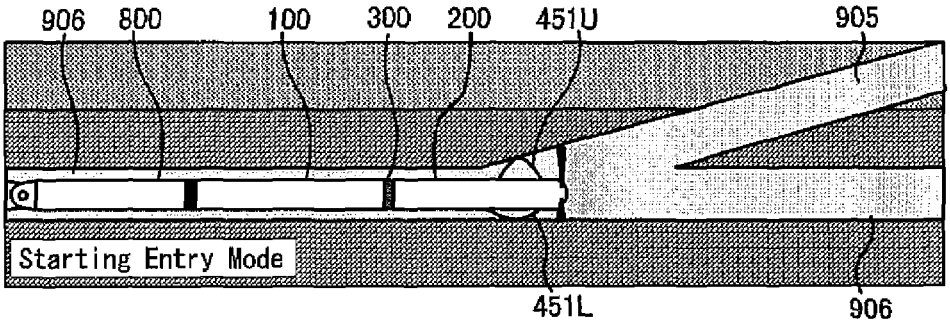

19A, the navigation apparatus operates in a mode that is seeking entry into the side-hole 905, i.e., a "side-hole finding mode". In the side-hole finding mode, the nose of the head member 200 is maintained along a path that is substantially along the center of the hole, i.e., along the HCL, as described above. Ultrasonic probe sensors operating in a look-around mode measure reflected waves from surfaces of the perimeter of the hole and mechanical arm sensors monitor the positions of an upper arm 451U and a lower arm 451L so that location of a side-hole 905 may be determined. When the ultrasonic probe sensors and mechanical arm sensors detect a change in the cross-sectional profile of the hole perimeter, as shown in FIG. 19B, the controller 700 (note FIG. 4B and related description above) switches operation of the navigation apparatus to a "side-hole entry mode" so that the tool 800 is "locked-onto" the side-hole 905. In the side-hole entry mode, a target position for entry into the side-hole 905 is determined based on data from the mechanical arm sensors and the ultrasonic probe sensors, and the head member 200 is manipulated so that the position of the nose of the head member 200 is located at the determined target position for entry into the side-hole.

Figure 19C:
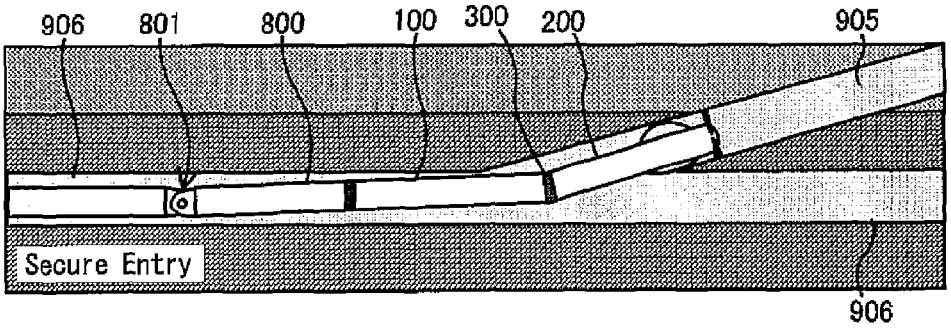
Figure 19D:
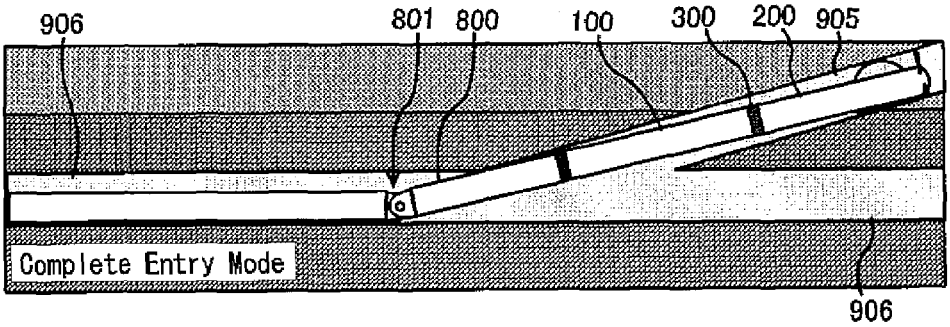

By navigating the nose with manipulation of the head member 200, the nose of the head member 200 enters the leading edge of the side-hole 905, as shown in FIG. 19C. The mechanical arm sensors detect entry into the side-hole 905 with positional information from the lower arm 451L, which is deformed as a result of contact with the lower edge of the side-hole 905. The ultrasonic probe sensors detect entry into the side-hole 905 by data from ultrasonic waves that are reflected from the lower edge of the side-hole 905. For entry into a side-hole, the tool 800 may be provided with a knuckle joint 801 as depicted in FIGS. 19C and 19D. After the entry into the side-hole 905, as depicted in FIG. 19D, the controller 700 may switch the operation mode of the navigation apparatus to another mode, such as the side-hole finding mode for entry into another side-hole.

In other embodiments contemplated by the present disclosure, the head member 200 may be manipulated based on predetermined trajectory data that are stored in, for example, memory associated with the navigation apparatus. In this, a "mission profile" based on previously known data, or data acquired in real time during the operation, relating to trajectory of a subterranean hole that is to be traversed by a tool may be stored in a suitable storage device. The disclosure herein contemplates the transmission of data from and to the navigation apparatus by any suitable technique, such as optical and electrical telemetry, so that data communication with the surface and other parts of the tool is possible. By storing a mission profile that is accessible to the navigation apparatus, the nose 210 of the head member 200 may be navigated in the hole relative to a reference point, for example, an opening into a side-hole that branches from a main hole. In this, as previously described, a sensor unit 400 measures or determines a position of the nose 210 of the head member 200, and a processor derives a target position for the nose 210 based on the previously stored trajectory data and the measured position data.

Figure 20:
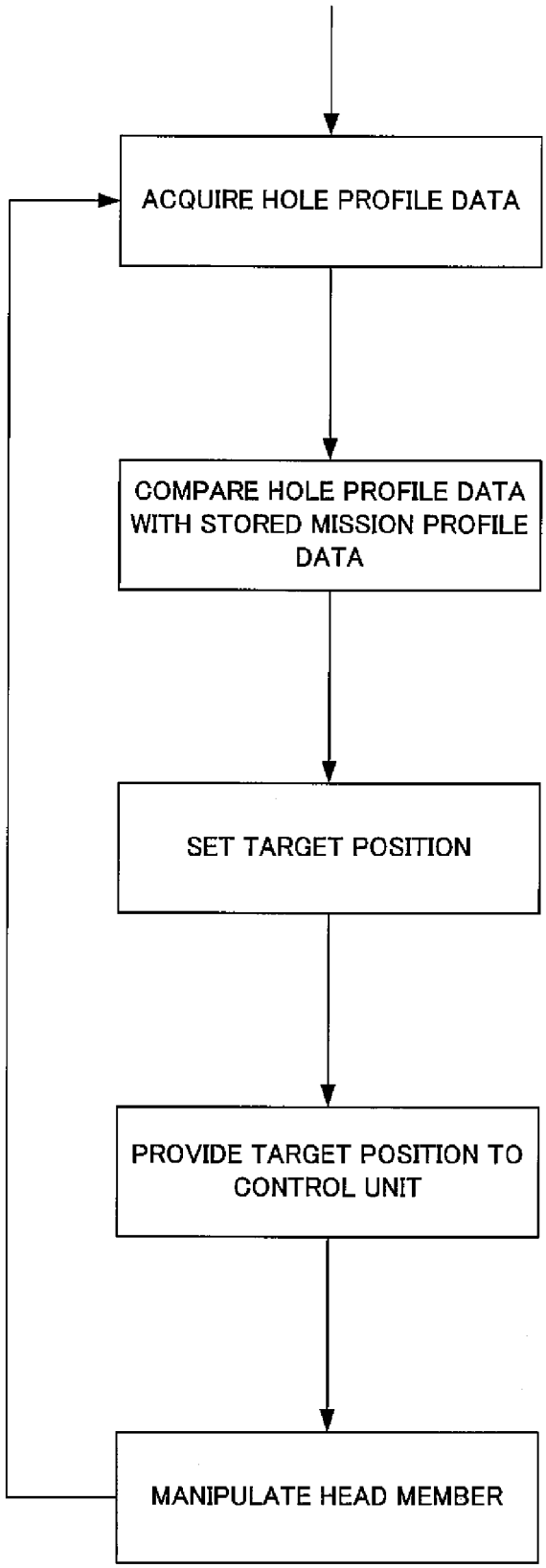
FIG. 20 is a flow chart depiction of another tool operation described herein.

FIG. 20 is a flowchart representation of operations for navigating a tool in a subterranean hole. The various techniques described herein may be used to acquire data relating to the hole, such as hole geometry, size, configuration. Such hole profile data that are acquired by the navigation apparatus may be used to navigate the tool in accordance with a predetermined mission for the tool. For example, ultrasonic waves reflected from perimeter walls of the hole may be used to derive hole size and a basic geometry of the hole. Similarly, caliper mechanisms may be used to trace or scan the hole surfaces surrounding the tool. Images from a suitable camera may be used with pattern recognition techniques to map the interior of the hole. Such data acquired by the tool downhole during its mission, which maps or profiles the route of the tool, are defined herein as acquired hole profile data. In addition, previously known information about the hole, such as trajectory, size, location of lateral holes, that is acquired during drilling, or by subsequent operations to map the hole, may be stored so as to be accessible to the navigation apparatus of the tool. Such data are described as mission profile data and may include predetermined commands that are executed by the controller 700 to control the actuator unit 600 (note FIG. 4B). In this, as the tool moves downhole, hole profile data acquired by the sensor unit 400, 450 of the tool are compared with mission profile data by the processor 500. Based on a fit between the data, the target position of the head member 200 is set. For example, if the acquired hole profile data suggest a washout, predetermined commands are executed to correct the tool position so that the tool is prevented from jamming in the washout. In this, an increase in the acquired diameter of the hole, as sensed by the sensor unit 400, 450, in comparison with the known bit size for the hole, as stored in the mission profile data, would suggest a washout. Similarly, if acquired hole profile data suggest a shape that flits an opening for a lateral hole, and the mission profile data confirm the possibility based on known depth and orientation of lateral holes in the main hole, the navigation apparatus would execute previously stored commands for side-hole entry, if such were the tool's mission at that time. Once a target position for the nose is set, the information is provided, in real time or through an operator at the surface, to the controller 700 so that the actuator unit 600 is controlled to manipulate the head member 200. The disclosure herein contemplates operator control based on the acquired hole profile data. In this, a surface operator may partially or fully control tool manipulation by the actuator unit 600 based on information derived from the navigation apparatus.

Other configurations of the navigation apparatus may be derived from the embodiments described herein. For example, a key may be provided on the lower body member 120 to be used as a reference point for moving the head member 200. The sensor unit may comprise a gyroscope or a combination of a geomagnetic sensor and acceleration sensor in order to decide the direction of the head member 200.

The techniques described above may be utilized for navigation of drill pipes and for navigating inspection tools in piping of various kinds, such as piping in oil refineries, oilfields, nuclear power plants.

The preceding description has been presented only to illustrate and describe certain embodiments and aspects. It is not intended to be exhaustive or to limit the invention to any precise form disclosed. Many modifications and variations are possible in light of the above teaching.

The embodiments and aspects were chosen and described in order to best explain the principles of the invention and its practical applications. The preceding description is intended to enable others skilled in the art to best utilize the principles described herein in various embodiments and with various modifications as are suited to the particular use contemplated. It is intended that the scope of the invention be defined by the following claims.

What is claimed is:

1. A navigation apparatus for a subterranean tool comprising:

a body member;

a head member steerably associated with the body member;

a determining unit configured to determine a transversal target position of a nose of the head member relative to the body member; and a steering unit configured to steer the head member relative to the body member so that the nose of the head member is located at the transversal target position, wherein the steering unit comprises:

an actuator unit configured to move the head member so that the position of the nose relative to the body member is changed; and a controller configured to control the actuator unit to move the head member so that the nose is located at the transversal target position, and wherein the actuator unit comprises a double-swing movement mechanism with a linking device configured to swing the head member in fixed two swing planes that are orthogonal to each other.

2. The apparatus according to claim 1, wherein the determining unit comprises:

a sensor unit configured to acquire information downhole relative to the location of the nose of the head member; and a processor configured to derive the transversal target position based on the location information.

3. The apparatus according to claim 2, wherein the sensor unit is further configured to measure at least two transversal distances between the nose and points on a hole perimeter surface adjacent to the nose of the head member.

4. The apparatus according to claim 2, wherein the sensor unit is further configured to measure a cross sectional profile of a hole perimeter surface adjacent to the nose of the head member.

5. The apparatus according to claim 2, wherein the sensor unit is further configured to acquire hole profile data relative to the location of the nose; and the processor is further configured to compare the acquired hole profile data with stored data to derive the transversal target position.

6. The apparatus according to claim 5, wherein the acquired hole profile data and the stored data include data selected from hole trajectory, hole geometry, drill bit size for drilling the hole, location of lateral holes, hole configuration.

7. The apparatus according to claim 6, wherein the stored data includes predetermined commands for steering the head member based on the derived target position.

8. The apparatus according to claim 5, wherein the processor is further configured to provide the transversal target position to the steering unit; and the steering unit comprises:

an actuator unit configured to move the head member so that the position of the nose relative to the body member is changed; and a controller configured to control the actuator unit to move the head member so that the nose is located at the transversal target position.

9. The apparatus according to claim 2, wherein the sensor unit is further configured to measure ultrasonic waves reflected from a perimeter surface.

10. The apparatus according to claim 9, wherein the sensor unit comprises:

a transmitter configured to transmit ultrasonic waves toward the hole perimeter surface; and a receiver configured to receive ultrasonic waves reflected from the perimeter surface.

11. The apparatus according to claim 2, wherein the sensor unit comprises:

a plurality of mechanical arm sensors, the sensor unit being further configured to measure positions of the arms.

12. The apparatus according to claim 11, wherein each mechanical arm sensor comprises:

an independently extendable and retractable arm;

a biasing mechanism configured to extend the arm toward a perimeter surface; and a position sensor configured to sense the position of the arm.

13. The apparatus according to claim 11, wherein the mechanical arm sensors are located on the head member such that each mechanical arm sensor contacts a different part of a perimeter surface when extended thereto.

14. The apparatus according to claim 13, wherein the mechanical arm sensors are symmetrically located on the head member with respect to the axis of the head member.

15. The apparatus according to claim 11, wherein each mechanical arm sensor has at least one end that is movable in an axial direction with respect to the head member; and the sensor unit further comprises a position sensor configured to output signals based on movement of the movable end of the arm.

16. The apparatus according to claim 2, wherein the sensor unit comprises one or more touch sensor.

17. The apparatus according to claim 1, wherein the determining unit comprises:

memory configured to store profile data with respect to a subterranean hole;

a sensor unit configured to acquire hole profile data relative to the location of the nose in the subterranean hole; and a processor configured to determine the target position of the nose based on the stored profile data and the acquired profile data.

18. The apparatus according to claim 17, wherein the sensor unit comprises a gyroscope.

19. The apparatus according to claim 17, wherein the sensor unit comprises a geomagnetic sensor and acceleration sensor.

20. The apparatus according to claim 1, wherein the apparatus is configured to be located at a terminal portion of a subterranean tool.

21. The apparatus according to claim 20, wherein the determining unit is further configured to determine a center position in a subterranean hole as the target position of the nose.

22. The apparatus according to claim 20, wherein the determining unit is further configured to determine an aperture of a lateral hole in a main subterranean hole as the target position of the nose head member.

23. The apparatus according to claim 1, wherein the apparatus is configured to be located at a terminal portion of a subterranean tool that is deployed by at least one of wireline, slickline, coiled tubing.

24. The method according to claim 23, wherein steering the head member comprises locating the head member at a center position in the hole.

25. The method according to claim 23, wherein steering the head member comprises locating the head member at an aperture of a side hole for entry to a lateral well.

26. A tool used in open holes or cased holes of subterranean wells, comprising:

a tool navigation apparatus, comprising:

a body member;

a head member steerably associated with the body member;

a determining unit configured to determine a transversal target position of a nose of the head member relative to the body member; and a steering unit configured to steer the head member so that the nose is located at the target position, wherein the determining unit is further configured to determine the target position of the nose based on hole profile data acquired by the navigation apparatus and predetermined mission profile data, wherein the steering unit comprises:

an actuator unit configured to manipulate the head member so that the relative transversal position of the nose of the head member is changed; and a controller configured to control the actuator unit so that the nose of the head member is located at the target position determined by the determining unit, and wherein the actuator unit comprises a double-swing movement mechanism with a linking device configured to swing the head member in fixed two swing planes that are orthogonal to each other.

27. The logging tool according to claim 26, wherein the determining unit comprises:

an acquisition unit configured to acquire hole profile data relative to the location of the nose of the head member; and a processor configured to derive the target position based on hole profile data acquired by the acquisition unit and predetermined mission profile data.

28. A method for navigating a tool in a subterranean hole comprising:

deploying a tool having a body member and a head member steerably associated with the body member;

determining a transversal target position of a nose of the head member relative to the body member; and steering the head member relative to the body member so that the nose of the head member is located at the transversal target position determined by the determining unit, the steering comprising a double swing movement mechanism with a linking device swinging the head member in fixed two swing planes that are orthogonal to each other so that the relative transversal position of the nose of the head member is changed.

* * * * *